US008225877B2

(12) United States Patent
Whiddon

(10) Patent No.: US 8,225,877 B2
(45) Date of Patent: Jul. 24, 2012

(54) DOWNHOLE RELEASE JOINT WITH RADIALLY EXPANDABLE MEMBERS

(75) Inventor: Richard Murray Whiddon, Katy, TX (US)

(73) Assignee: Enventure Global Technology, L.L.C., Houston, TX (US)

( * ) Notice: Subject to any disclaimer, the term of this patent is extended or adjusted under 35 U.S.C. 154(b) by 355 days.

(21) Appl. No.: 12/604,007

(22) Filed: Oct. 22, 2009

(65) Prior Publication Data

US 2011/0094753 A1 Apr. 28, 2011

(51) Int. Cl.
*E21B 43/10* (2006.01)

(52) U.S. Cl. ..... 166/380; 166/384; 166/207

(58) Field of Classification Search ..... 166/380, 166/384, 207, 208
See application file for complete search history.

(56) References Cited

U.S. PATENT DOCUMENTS

| | | | | |
|---|---|---|---|---|
| 6,892,819 | B2 | 5/2005 | Cook | |
| 6,966,370 | B2 | 11/2005 | Cook | |
| 6,997,264 | B2 | 2/2006 | Simpson et al. | |
| 7,063,142 | B2 | 6/2006 | Cook | |
| 7,104,322 | B2 * | 9/2006 | Whanger et al. | 166/277 |
| 7,121,337 | B2 | 10/2006 | Cook | |
| 7,198,100 | B2 | 4/2007 | Cook | |
| 7,216,701 | B2 | 5/2007 | Cook | |
| 7,240,729 | B2 | 7/2007 | Cook | |
| 7,240,928 | B2 | 7/2007 | Evans et al. | |
| 7,383,889 | B2 | 6/2008 | Watson | |
| 7,424,918 | B2 | 9/2008 | Costa | |
| 7,434,618 | B2 | 10/2008 | Cook | |
| 7,775,290 | B2 | 8/2010 | Brisco | |
| 7,789,140 | B2 | 9/2010 | Noel | |
| 2004/0194966 | A1 | 10/2004 | Zimmerman | |
| 2008/0142213 | A1 * | 6/2008 | Costa et al. | 166/250.01 |

* cited by examiner

*Primary Examiner* — David Andrews
(74) *Attorney, Agent, or Firm* — Derek V. Forinash; Porter Hedges LLP

(57) ABSTRACT

A downhole releasable tubing connection includes a joint between two tubing strings, wherein one of the two tubing strings is radially expanded and plastically deformed by an expansion device. When the expansion device is moved adjacent to the joint, a mechanism in the joint reacts to the radially outward forces of the expansion device and releasably expands, separates, breaks, or otherwise provides a release between the two tubing strings. One tubing string and the expansion device can then be removed to the surface of the well bore while the expanded tubing remains installed in the well bore.

13 Claims, 25 Drawing Sheets

DOWNHOLE RELEASE JOINT WITH RADIALLY EXPANDABLE MEMBERS

BACKGROUND

This disclosure relates generally to hydrocarbon exploration and production, and in particular to forming well bore tubular strings and connections to facilitate hydrocarbon production or downhole fluid injection.

During hydrocarbon exploration and production, a well bore typically traverses a number of zones within a subterranean formation. A tubular system may be established in the well bore to create flow paths between the multiple producing zones and the surface of the well bore. Efficient completion of the well bore or production from the surrounding formation is highly dependent on the inner diameter of the tubular system installed in the well bore. Greater inner diameters of the tubular string allows inserted equipment and fluids with appropriate pressure ratings to be used in well completions, while also allowing increased production of hydrocarbons thereafter.

Expandable tubing may be used to increase the inner diameter of casing, liners and other similar downhole tubular strings used as described above. To create a casing, for example, a tubular member is installed in a well bore and subsequently expanded by displacing an expansion device through the tubular member. The expansion device may be pushed or pulled using mechanical means, such as by a support tubular coupled thereto, or driven by hydraulic pressure. As the expansion device is displaced axially within the tubular member, the expansion device imparts radial force to the inner surface of the tubular member. In response to the radial force, the tubular member plastically deforms, thereby permanently increasing both its inner and outer diameters. In other words, the tubular member expands radially. Expandable tubulars may also be used to repair, seal, or remediate existing casing that has been perforated, parted, corroded, or damaged since installation.

In some circumstances, after the radial expansion and plastic deformation process, the expansion tools and any other tools associated therewith may need to be removed to the surface of the well bore. Some operations include a separate trip into the well bore, wherein a retrieval tool is lowered and coupled to the expansion tools for retrieval to the surface. In other operations, the upper unexpanded tubular string and the tools coupled thereto are separated from the lower expanded and installed tubular string for removal to the surface. To separate the unexpanded tubular string from the expanded tubular string, a cutter is used. A casing cutter may be part of the initial tool string such that the casing may be cut without an additional trip. However, the cutter operation is time-consuming and creates collateral damage to the casing. It is clear the aforementioned apparatus and methods are problematic.

The principles of the present disclosure are directed to overcoming one or more of the limitations of the existing apparatus and processes for separating expanded tubing from unexpanded tubing and associated tools.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
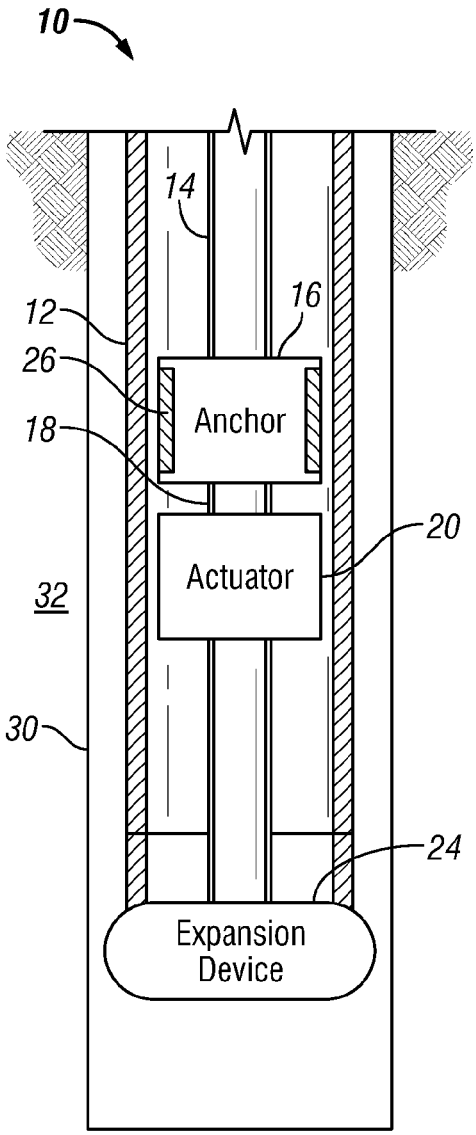
FIG. 1 is a fragmentary cross-sectional illustration of an apparatus for installing an expandable tubular member within a preexisting structure.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. The terms "pipe," "tubular member," "casing" and the like as used herein shall include tubing and other generally cylindrical objects. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, an embodiment of an expansion apparatus 10 for radially expanding and plastically deforming a tubular member 12 includes a tubular support member 14 that is coupled to an end of an anchor 16 for controllably engaging the tubular member via resilient member 26. Another end of the anchor 16 is coupled to a tubular support member 18 that is coupled to an end of an actuator 20. Another end of the actuator 20 is coupled to a tubular support member 22 that is coupled to an end of an expansion device 24 for radially expanding and plastically deforming the tubular member 12. The anchor 16, the tubular support member 18, the actuator 20, and the tubular support member 22 are positioned within the tubular member 12.

Figure 2:
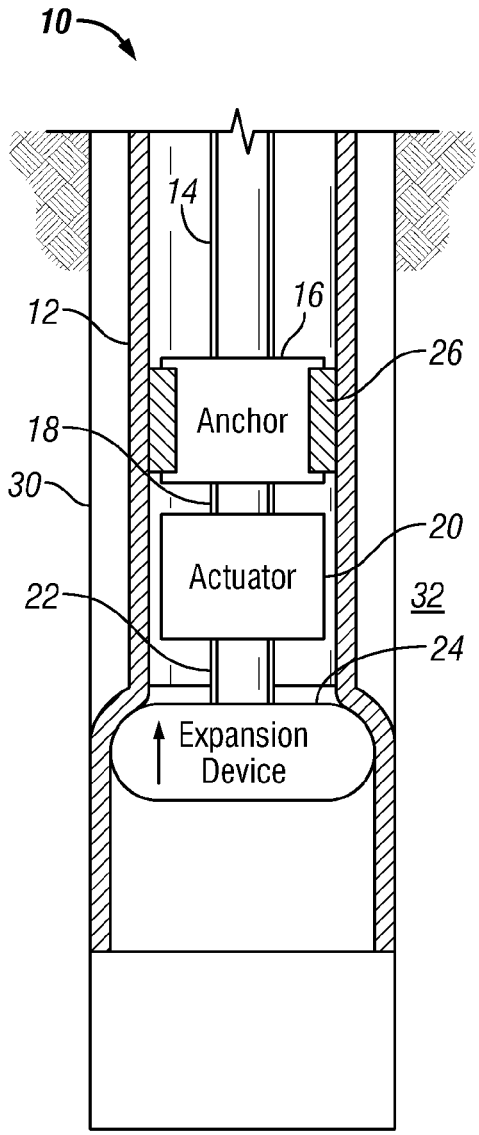
FIG. 2 is a fragmentary cross-sectional illustration of the apparatus of FIG. 1 after displacing the expansion device within the expandable tubular member.

In one embodiment, the expansion apparatus 10 is positioned within a preexisting structure 30 such as, for example, a wellbore that traverses a subterranean formation 32. Once tubular member 12 and expansion apparatus 10 are disposed at a desired location within structure 30, anchor 16 is activated. The activation of anchor 16 causes resilient member 26 to deform and engage tubular member 12 so as to releasably couple anchor 16 to tubular member 12. As a result, the axial position of anchor 16 is fixed relative to tubular member 12, as shown in FIG. 2. Once anchor 16 is releasably coupled to tubular member 12, actuator 20 can be activated to axially displace the expansion device 24 relative to tubular member 12. The axial displacement of expansion device 24 radially expands and plastically deforms a portion of the tubular member 12.

It is understood that expansion apparatus 10 is only one embodiment of a system utilizing an anchor, actuator, and expansion device and other such systems may be contemplated or are known in the art. Expansion apparatus 10 may also utilize any actuator that provides sufficient force to axially displace the expansion device through the expandable tubular. The actuator may be driven by hydraulic pressure, mechanical forces, electrical power, or any other suitable power source. In alternative embodiments, the expansion device may be a solid mandrel having a fixed outer diameter, an adjustable or collapsible mandrel with a variable outer diameter, a roller-type expansion device, or any other device used to expand a tubular. Such expansion devices may not require an actuator, instead driven by hydraulic pressure or by forces from the drilling rig. Still further, although illustrated in FIG. 1 as having an initial position external to the expandable tubular member and configured for upward expansion, in certain embodiments, the expansion device may have an initial position within the tubular and/or be configured for downward expansion. It is also understood that the tubulars that internally receive the expansion apparatus 10 are configured to allow pass-through of the expansion apparatus 10, and radially expand in response to the enlarged diameter of the expansion apparatus 10 and plastically deform to an enlarged diameter as a result of the expansion apparatus pass-through.

Figure 3:
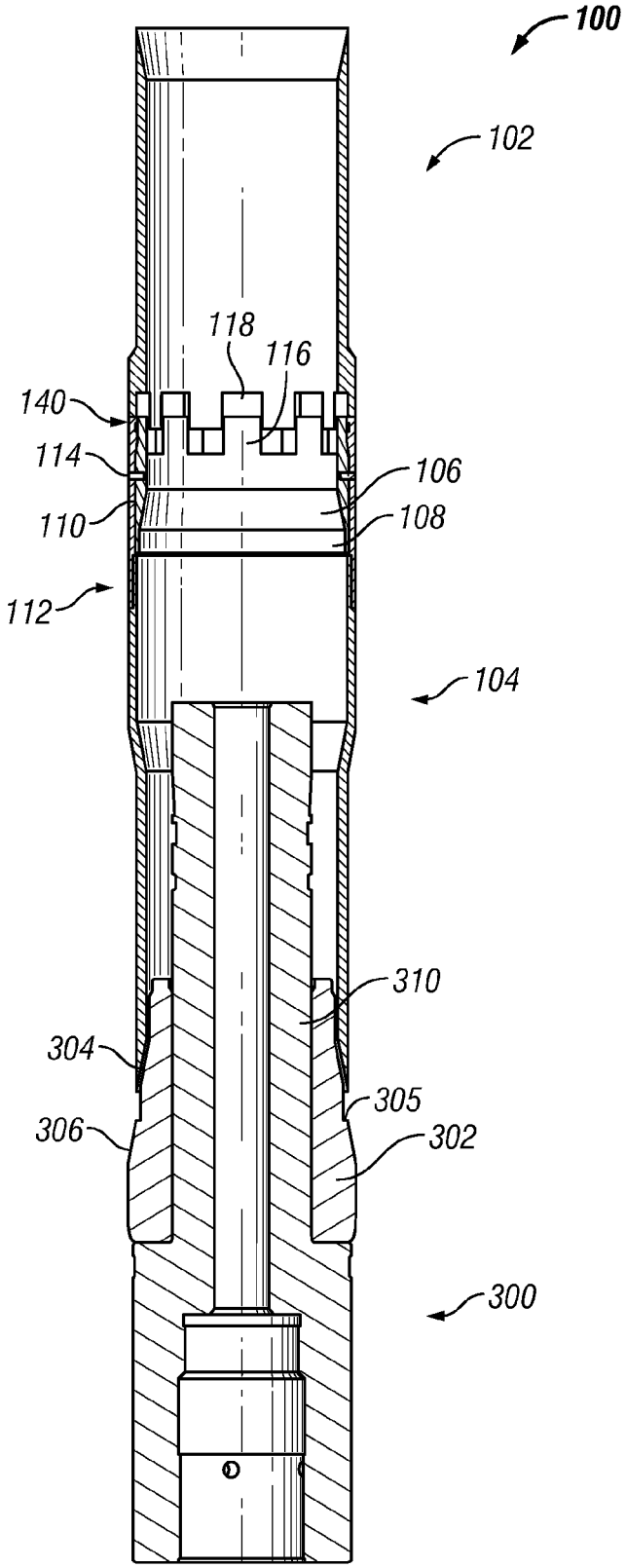
FIG. 3 is a cross-section view of a releasable joint assembly and expansion device in accordance with principles taught herein.

Referring now to FIG. 3, a releasable joint or connection assembly 100 is shown in cross-section. In various embodiments described herein, the assembly 100 may also be referred to as a separation or break mechanism for two tubular strings. In some embodiments, an expansion device 300 is applied to the releasable joint assembly 100. For cross-section and perspective views of the releasable joint assembly 100, reference may be made to FIGS. 4 and 5, respectively.

Figure 4:
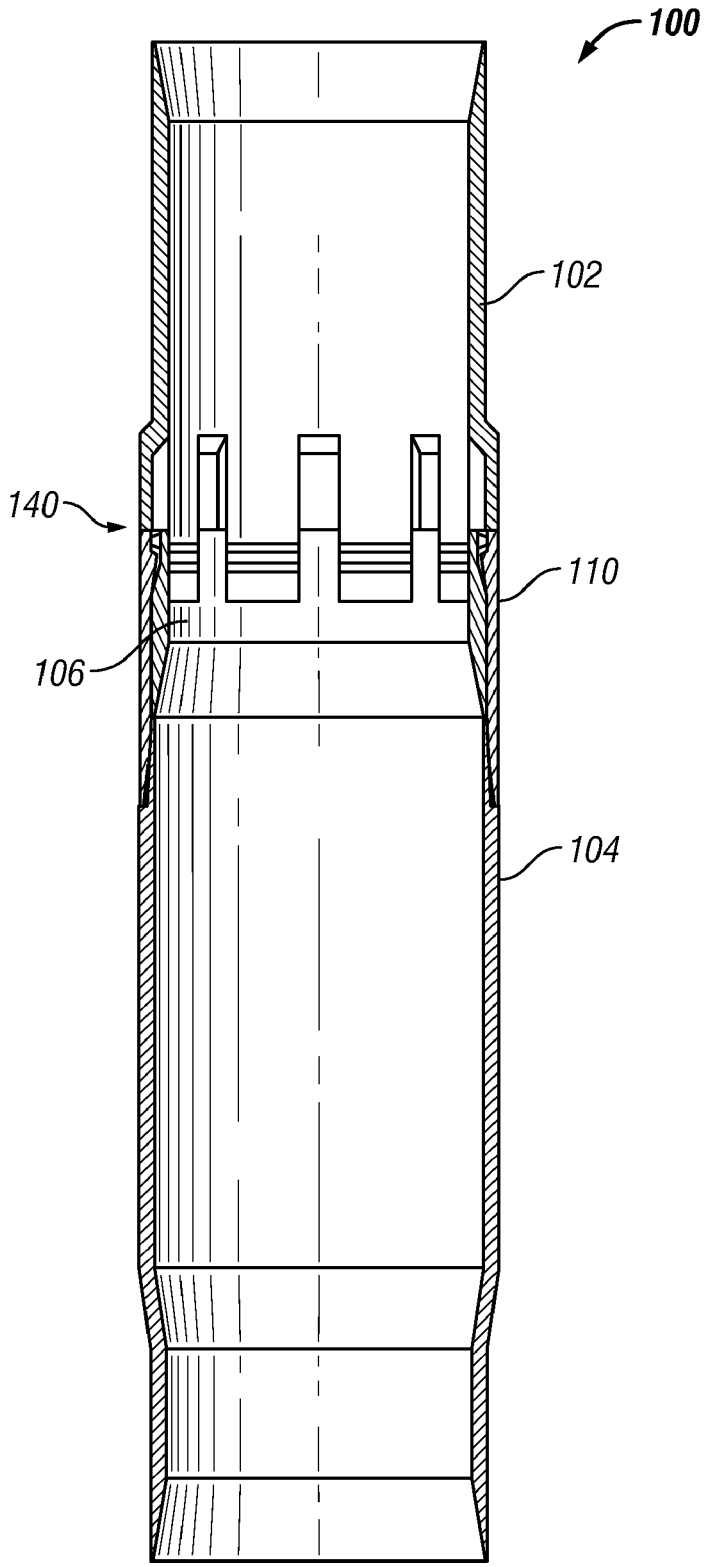
FIG. 4 is a cross-section view of the releasable joint assembly of FIG. 3.
Figure 5:
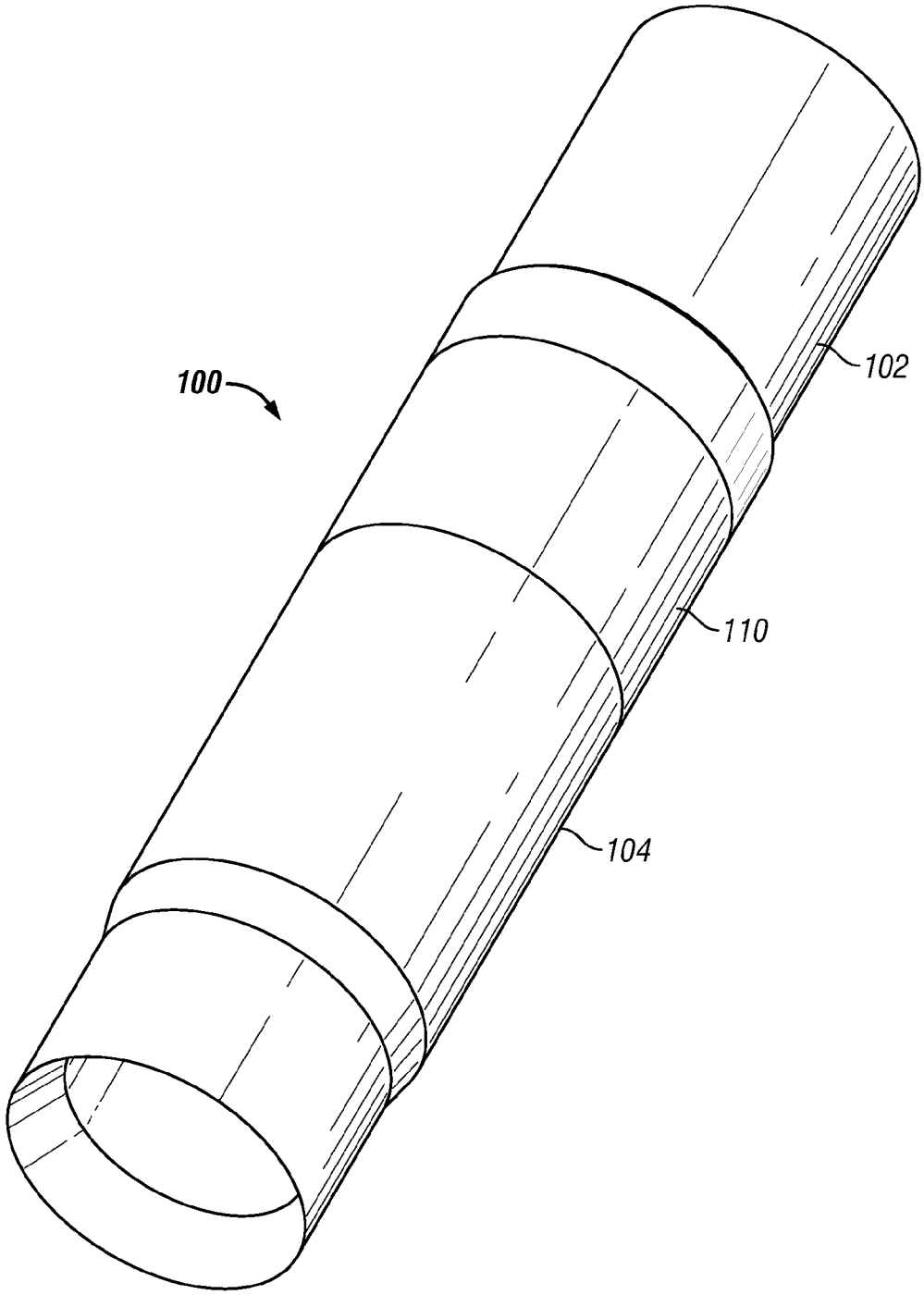
FIG. 5 is a perspective view of the releasable joint assembly of FIGS. 3 and 4.

The releasable joint assembly 100 includes an upper tubular member 102 and a lower tubular member 104. In some embodiments, the upper tubular member 102 is an adapter for coupling with a tubular string above the assembly 100. Likewise, the lower tubular member 104 may be an adapter for coupling to a lower expandable tubular string. The lower tubular member 104 includes an upper sliding member receptacle 110 coupled at a connection 112. In various embodiments, the connection 112 comprises a threaded, welded or brazed connection. The sliding member receptacle 110 is coupled to the upper tubular member 102 at a connection 140, the details of which will be described more fully below. Disposed primarily in the sliding member receptacle 110 and adjacent the connection 140 is a sliding member 106. The sliding member 106 includes a lower seat portion 108 and upper splines or tabs 116. The splines 116 are disposed in slots 118 on an inner surface of the upper tubular member 102. The interlocking splines 116 and slots 118 provide a rotational lock in the assembly 100. In some embodiments, the sliding member 106 is secured by releasable members 114, such as shear pins. The arrangement as shown in FIGS. 3-5 represents an initial assembled and deployed position, before substantial interaction with the expansion device 300.

Upon initial application of the expansion device 300 to the releasable joint assembly 100, a support tubular 310 is guided into and through the lower tubular 104 which in turn directs an expansion cone 302 into the lower tubular 104. A first tapered expansion surface 304 is applied to the inner surface of the lower tubular member 104. The expansion cone 302 may also include a second tapered expansion surface 306, with a shoulder or ledge 305 disposed between the two tapered expansion surfaces. As previously noted herein, other known expansion devices are contemplated for displacing a member through the releasable joint assembly 100 that will apply a radially outward force to the inner surface of the assembly 100.

Figure 6:
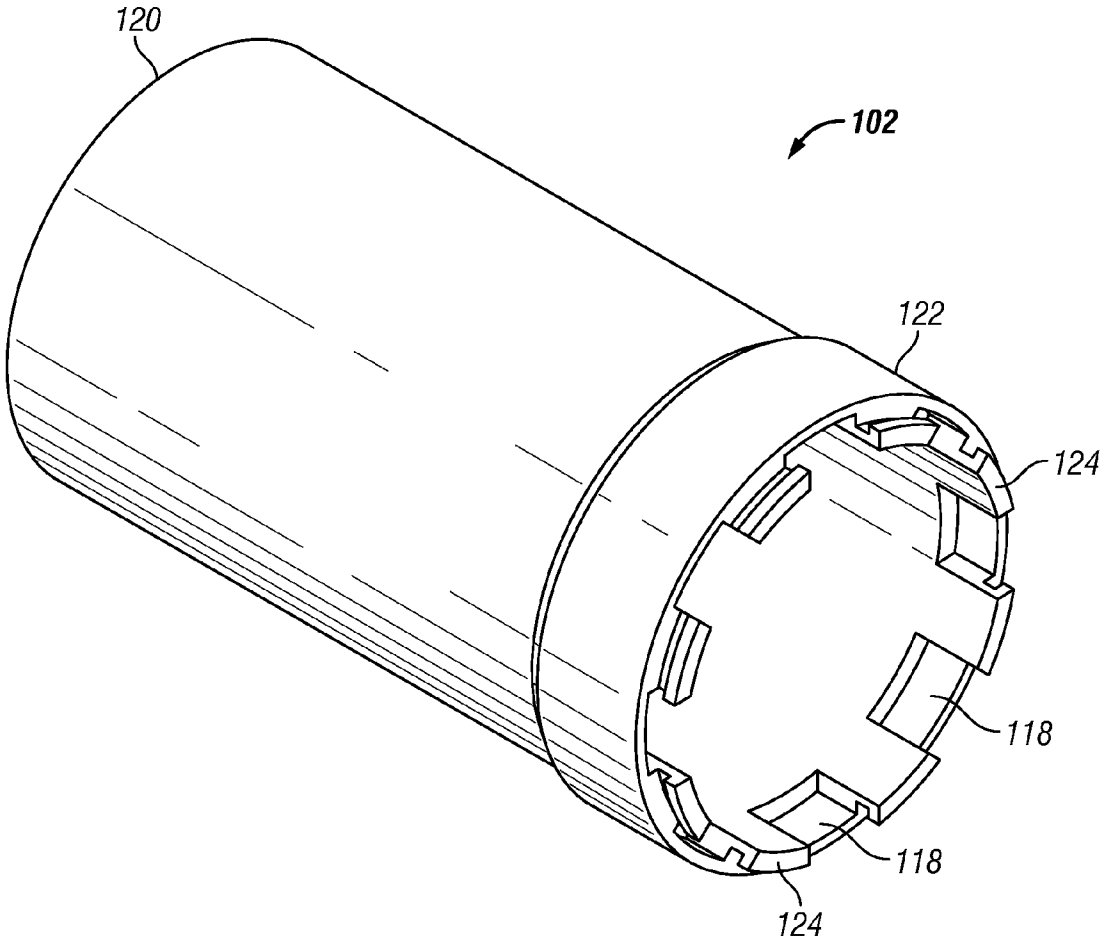
FIG. 6 is a perspective view of the upper tubular member of the releasable joint assembly of FIGS. 3-5.

Referring to FIG. 6, a perspective view is shown of the upper tubular member 102 isolated from the assembly 100.

The upper tubular member 102 includes an upper end 120 and a lower end 122. The lower end 122 includes a series of circumferentially spaced-apart and alternating slots 118 and latches or hooks 124.

Figure 7:
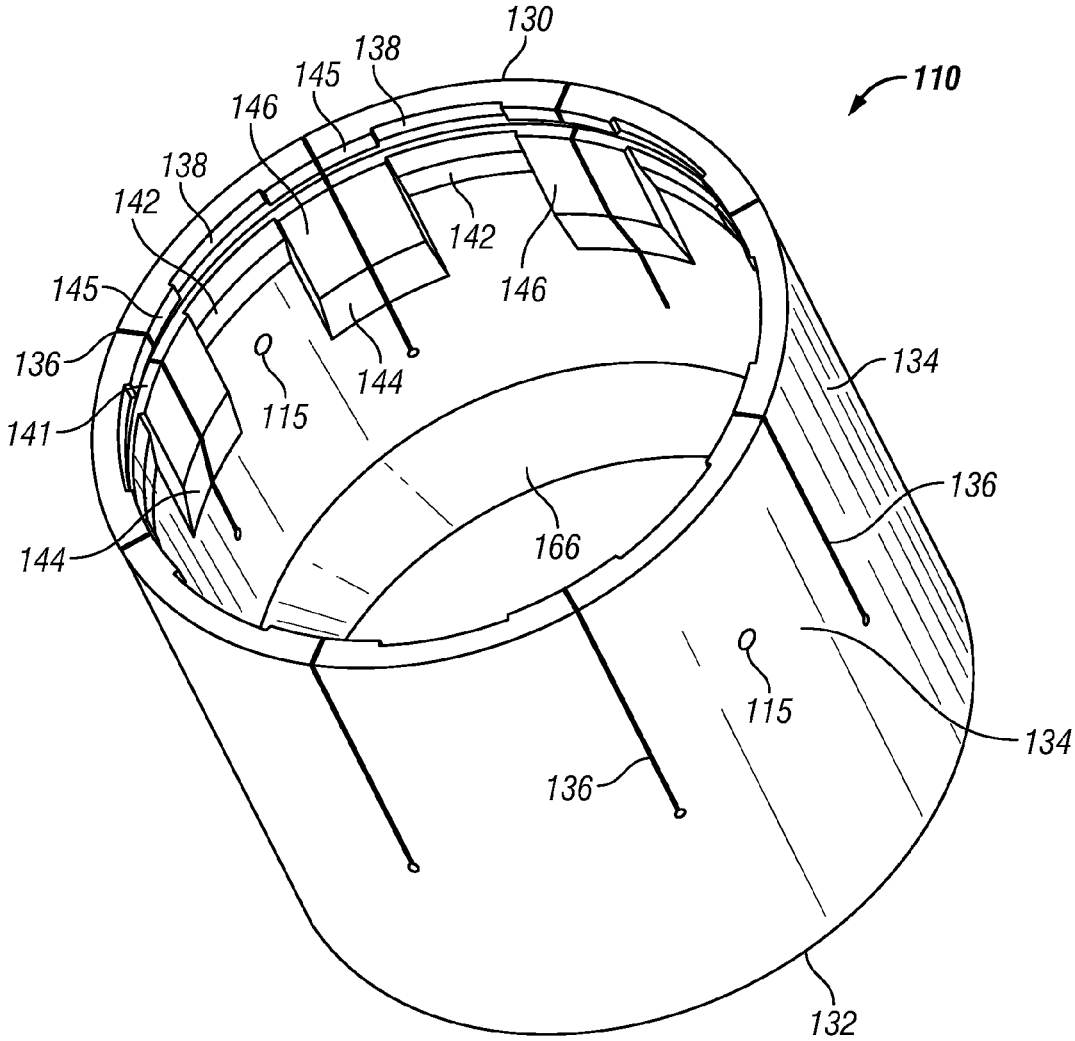
FIG. 7 is a perspective view of the sliding member receptacle of the releasable joint assembly of FIGS. 3-5.

Referring to FIG. 7, a perspective view is shown of the sliding member receptacle 110 isolated from the assembly 100. The receptacle 110 includes an upper end 130 and a lower end 132. The upper end 130 includes a collet mechanism including a series of circumferentially alternating collet fingers 134 and collet slots 136. The colleted end 130 is therefore adapted for releasable radial expansion of the collet fingers 134, such as for expanding release of a member disposed inside the colleted end 130. The inner surface of the colleted end 130 includes a series of spaced-apart slots 138 and a circumferential retention groove 141. The slots 138 include upper angled or tapered surfaces 142 while reduced inner diameter portions 146 include lower angled or tapered surfaces 144. The retention groove 141 extends through portions of the reduced diameter portions 146 to form hooks or latches 145. The collet slots 136 extend through the reduced diameter portions 146. Certain of the collet fingers 134 may include shear pin holes 115 in certain embodiments.

Figure 8:
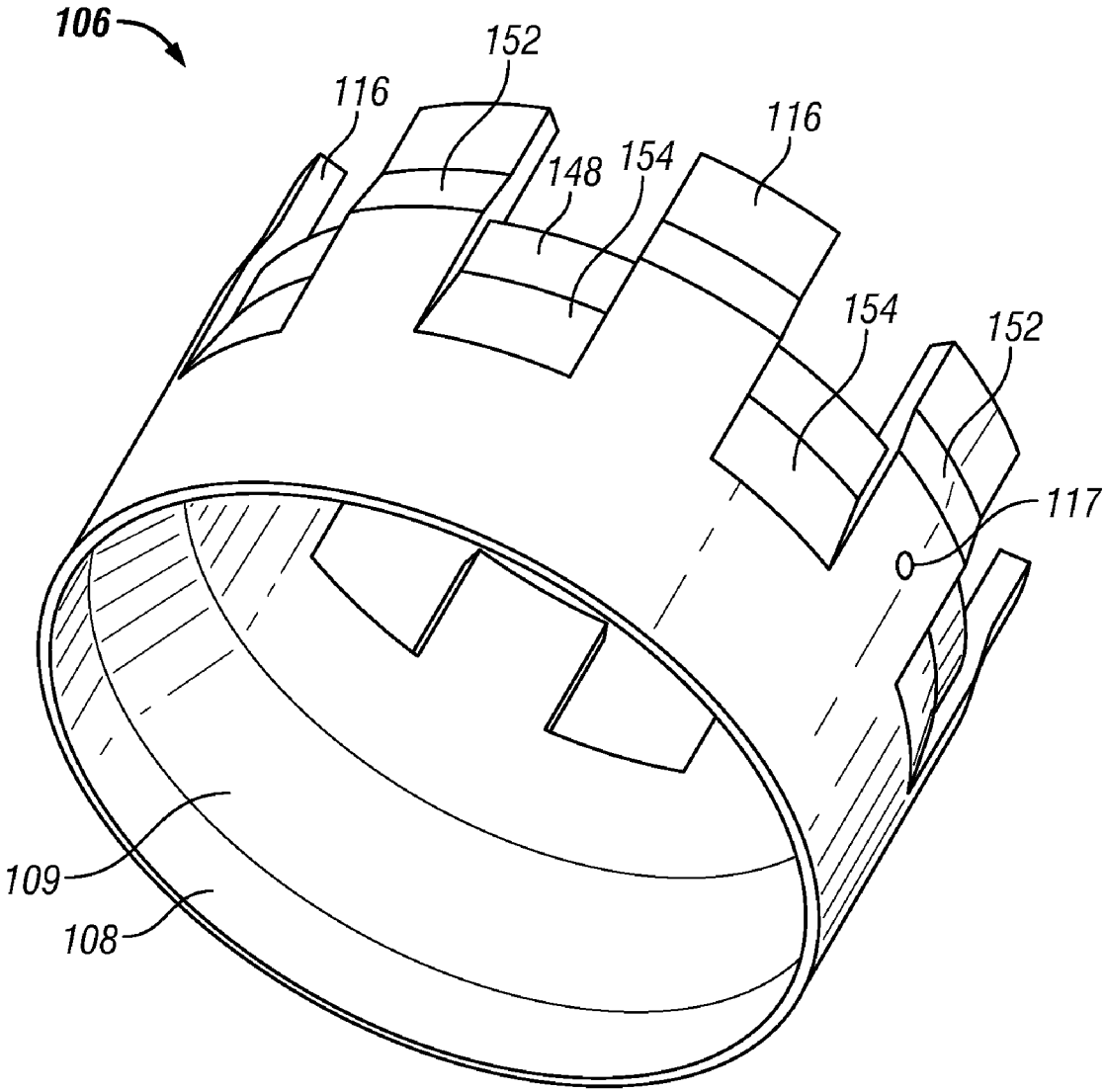
FIG. 8 is a perspective view of the sliding member of the releasable joint assembly of FIGS. 3-5.

Referring to FIG. 8, a perspective view of the sliding member 106 shows the lower seat portion 108 including a tapered or angled surface 109. The upper splines or fingers 116 include upper tapered surfaces 152 while circumferentially alternating slots 148 include lower tapered surfaces 154. Certain of the splines 116 include shear pin holes 117.

Figure 9:
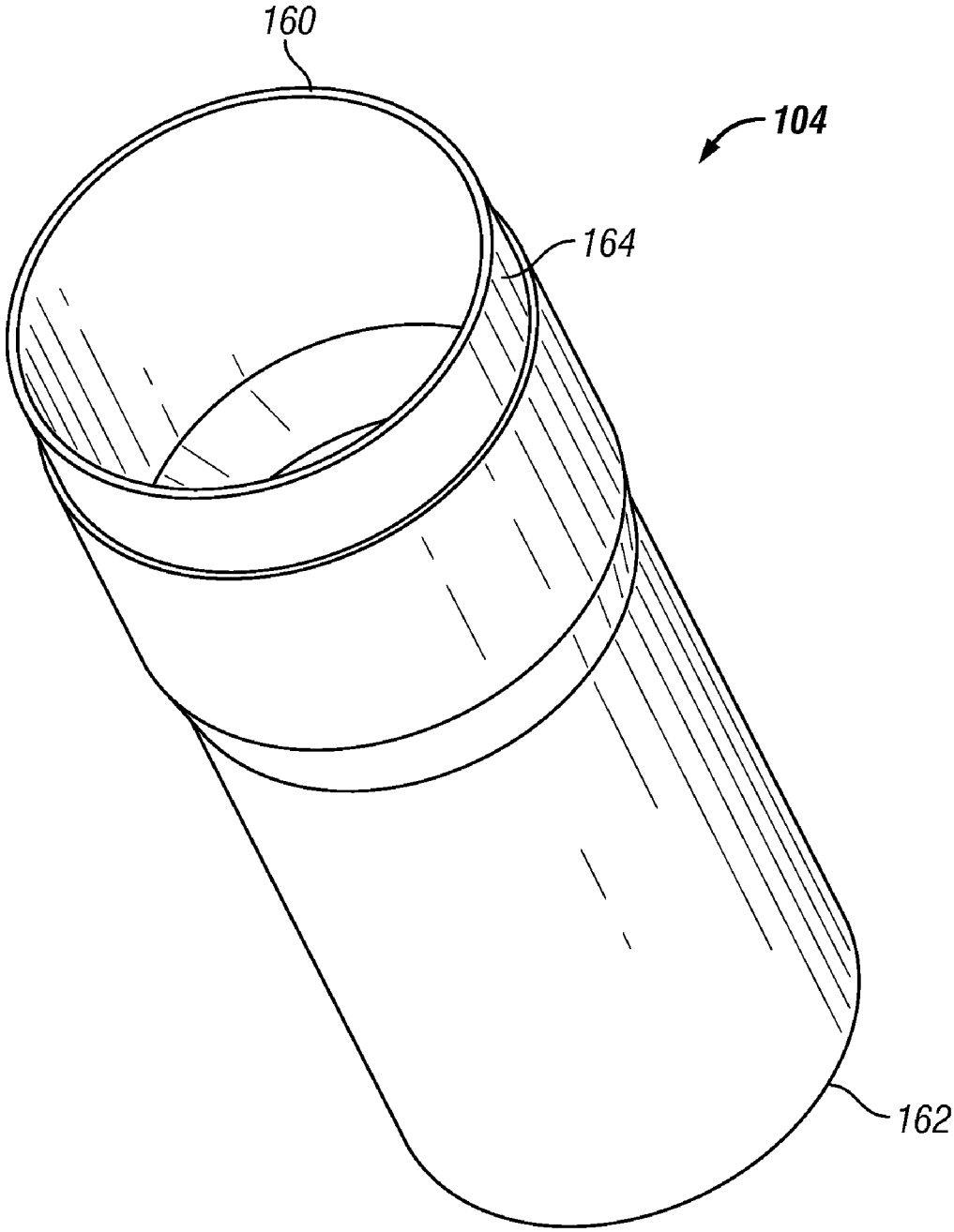
FIG. 9 is a perspective view of the lower tubular member of the releasable joint assembly of FIGS. 3-5.

Referring to FIG. 9, a perspective view of the lower tubular member 104 shows an upper end 160 and a lower end 162. The upper end 160 includes an outer connection surface 164 that mates with an inner connection surface 166 of the sliding member receptacle 110 (FIG. 7) to form the connection 112 (FIG. 3).

Figure 10:
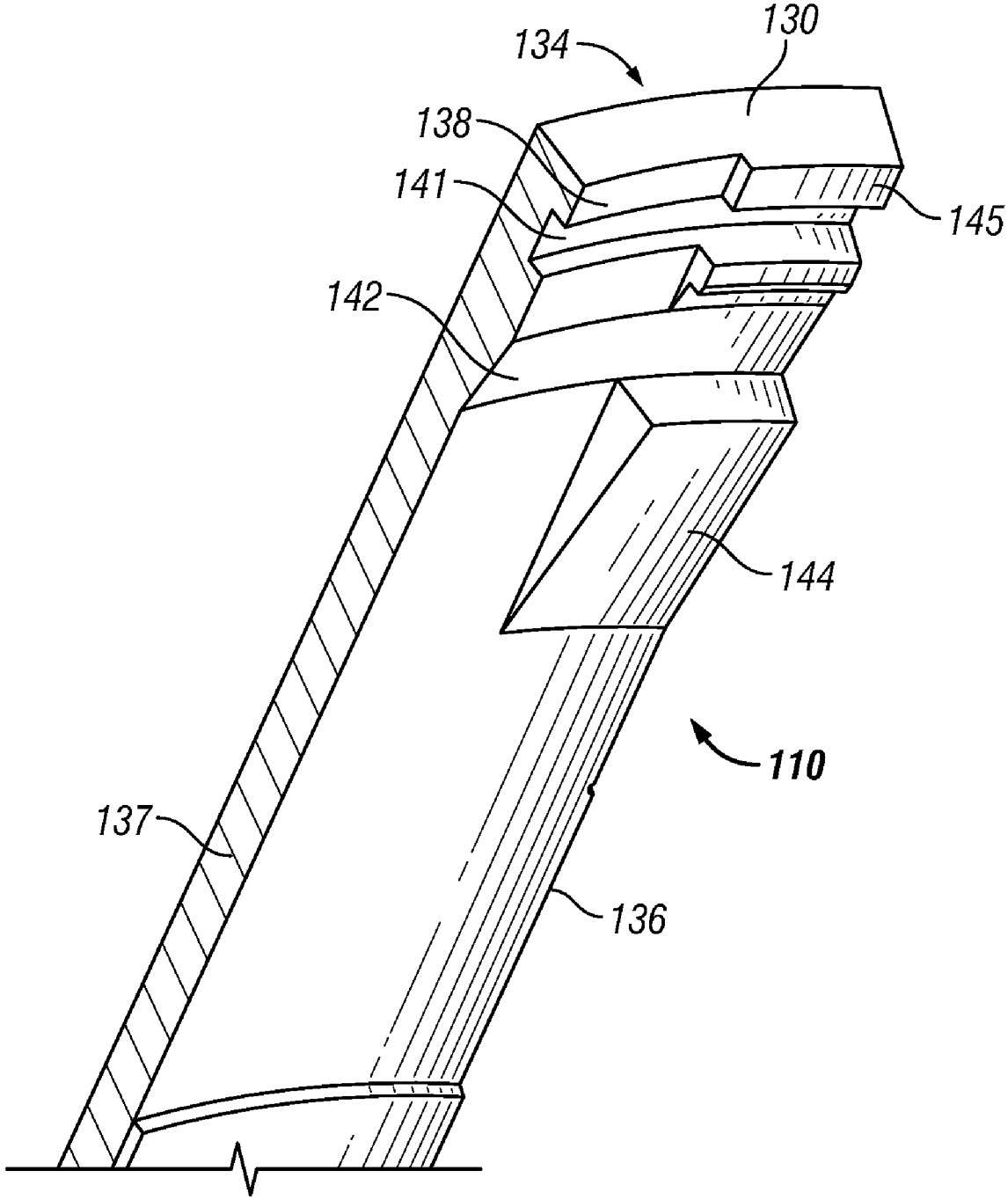
FIG. 10 is a cutaway view of a collet finger of the sliding member receptacle of FIG. 7.
Figure 11:
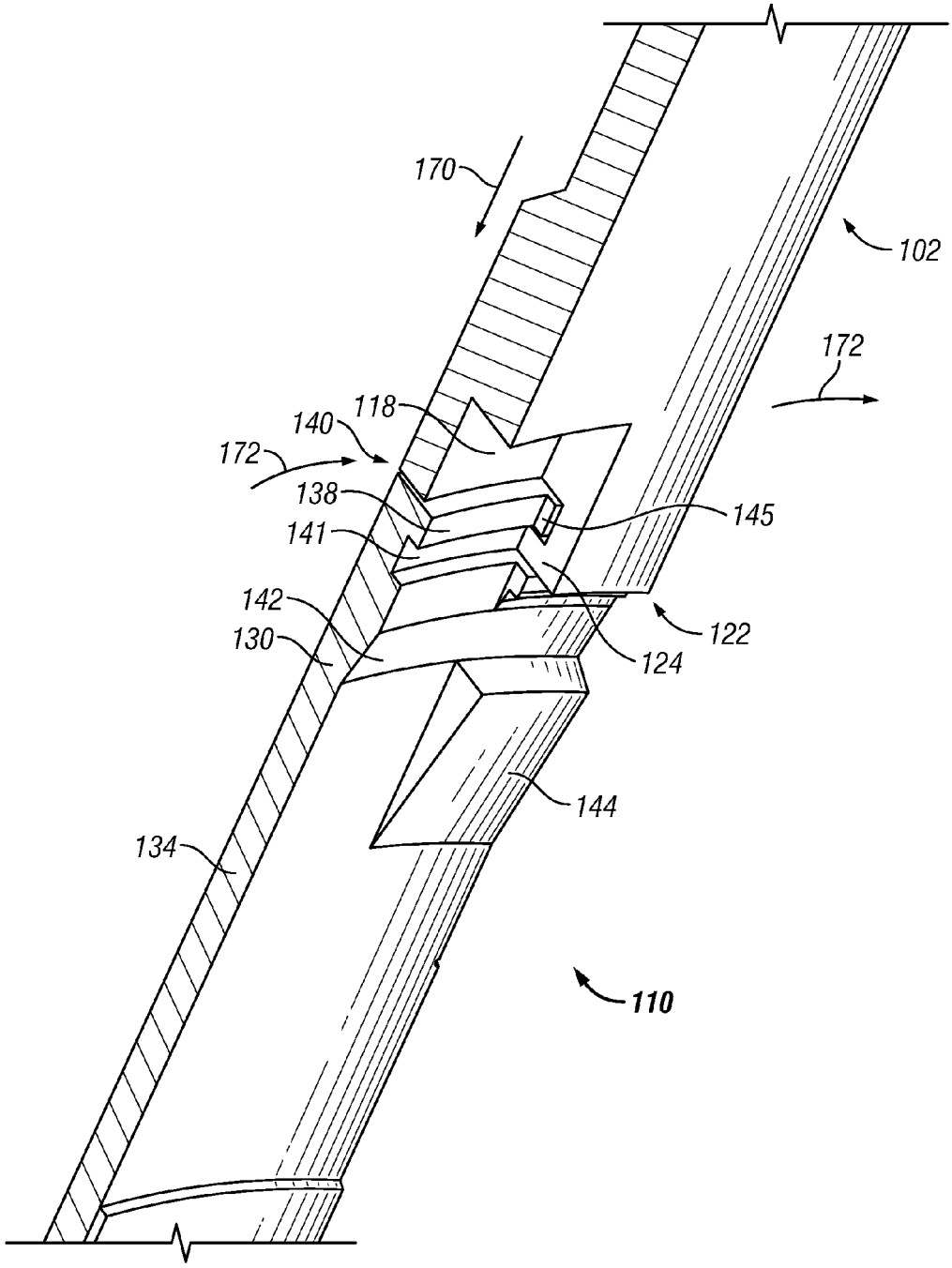
FIG. 11 is a cutaway view of the collet finger of FIG. 10 secured to the upper tubular member of FIG. 6 to form a collet connection.
Figure 12:
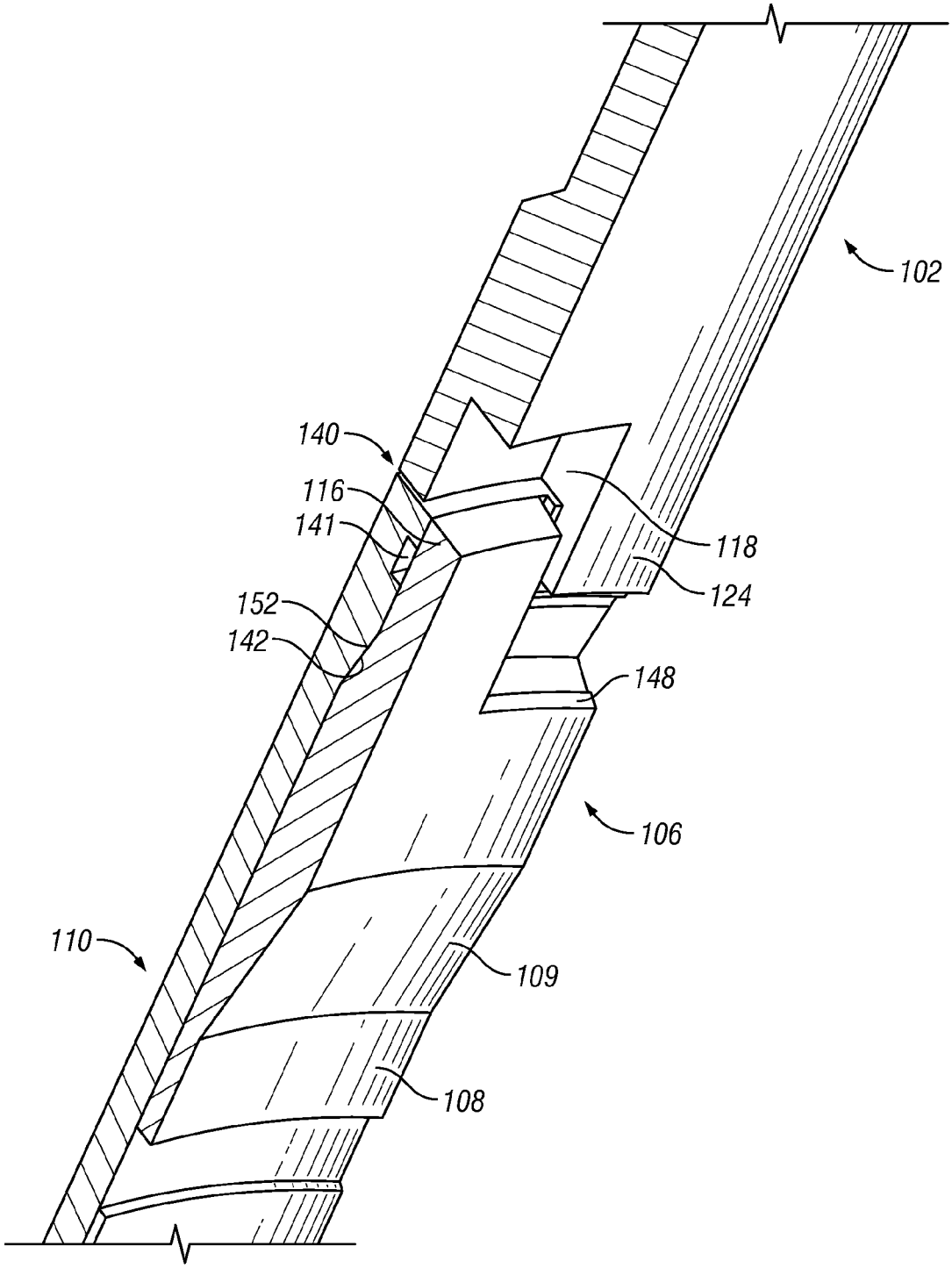
FIG. 12 is a cutaway view of the collet connection of FIG. 11 including the sliding member of FIG. 8 secured therein.

To illustrate assembly and connection of the releasable joint 100, reference is now made to the partial cutaway views of FIGS. 10-12. In FIG. 10, a cutaway view of a collet finger 134 includes a collet slot 136 to one side and to the other side a section 137 taken at the middle portion of the collet finger 134. The colleted end 130 includes the slot 138, the retention groove 141, the latch 145, the upper tapered surface 142 and the lower tapered surface 144.

Referring now to FIG. 11, the upper tubular member 102 and the sliding member receptacle 110 are moved axially relative to each other, such as by moving the upper tubular member 102 in the direction of arrow 170. Initially, the latches 124 of the tubular member 102 are aligned with the slots 138 in the receptacle 110 so that the latches 124 extend into the retention groove 141. Some outward movement of the collet finger 134 may be allowed such that the latch 124 fits over the upper slot 138 and into the retention groove 141. To fully secure the tubular end 122 to the colleted end 130, the tubular member 102 and the receptacle 110 are rotated relative to each other, such as by rotating the tubular member 102 in the direction of arrow 172 to place the latch 124 in mating engagement with the latch 145. This forms the collet connection 140, which is a radial expansion release mechanism between the upper tubular member 102 and the receptacle 110.

Referring to FIG. 12, the sliding member 106 is now introduced into the receptacle 110. With the splines 116 first, the sliding member 106 is slidingly engaged with the lower end 132 of the receptacle 110 and into the collet connection 140. When engaged with the collet connection 140, the splines 116 are aligned with the slots 118, 138, fully disposed in the slots 138 and partially disposed in the slots 118. The interlocking of splines 116 in the slots 118, 138 provides a rotational lock of the slider 106 relative to the receptacle 110 and the upper tubular member 102. The slots 148 are aligned with the latches 124. The upper tapered surfaces 152 of the receptacle 110 are matingly engaged with the upper tapered surfaces 142 of the slider 106. Also, though not shown, the lower tapered surfaces 154 of the receptacle 110 are matingly engaged with the lower tapered surfaces 144 of the slider 106. To releasably secure the slider 106 in this initial assembled and run-in position, the shear pins 114 may be secured through the shear pins holes 115, 117 in certain embodiments. Other embodiments include other means for releasably securing the slider 106 to the receptacle 110.

Figure 13:
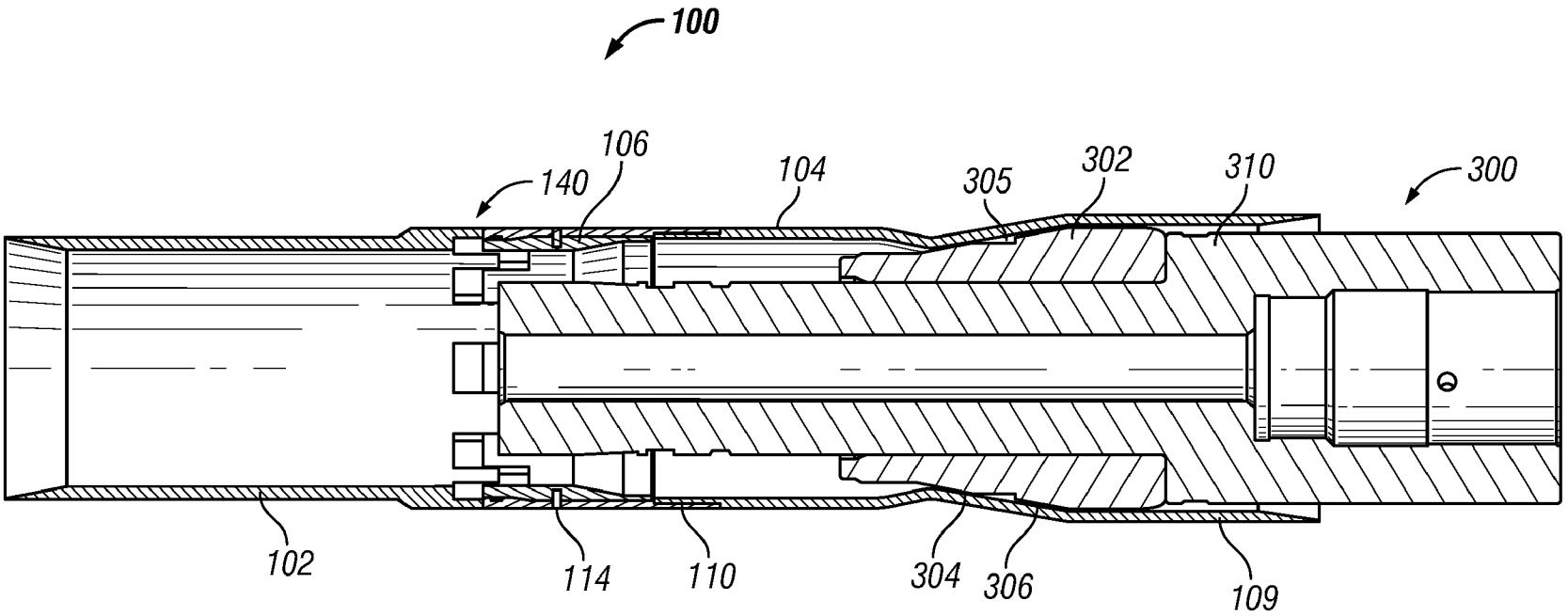
FIG. 13 is a cross-section view of the releasable joint assembly and expansion device of FIG. 3, with the expansion device radially expanding the lower tubular member.

The assembled and deployed releasable joint assembly 100 can be coupled into upper and lower tubing strings using the upper and lower pipe adapters 102, 104, respectively. When a lower tubing string is radially expanded and plastically deformed, such as with tubular member 12 in FIGS. 1 and 2, eventually the expansion device 24, 300 engages the lower end 162 of the lower tubular member 104, as is shown in FIG. 3. The position in the tubing string of the releasable joint assembly 100 can be predetermined, for example, based on the desired quantity or length of the lower expanded tubing 12. Then, as shown in FIG. 13, the expansion device 300 is axially displaced through the lower tubular member 104. As the tapered expansion surfaces 304, 306 of the expansion cone 302 exert radially outward forces on the inner surface of the tubular member 104, the lower portion 109 of the tubular member 104 become radially expanded and plastically deformed. The support tubular 310 moves through the assembly 100 unimpeded because its portions are less than the inner diameter of the respective portions of the assembly 100.

Figure 14:
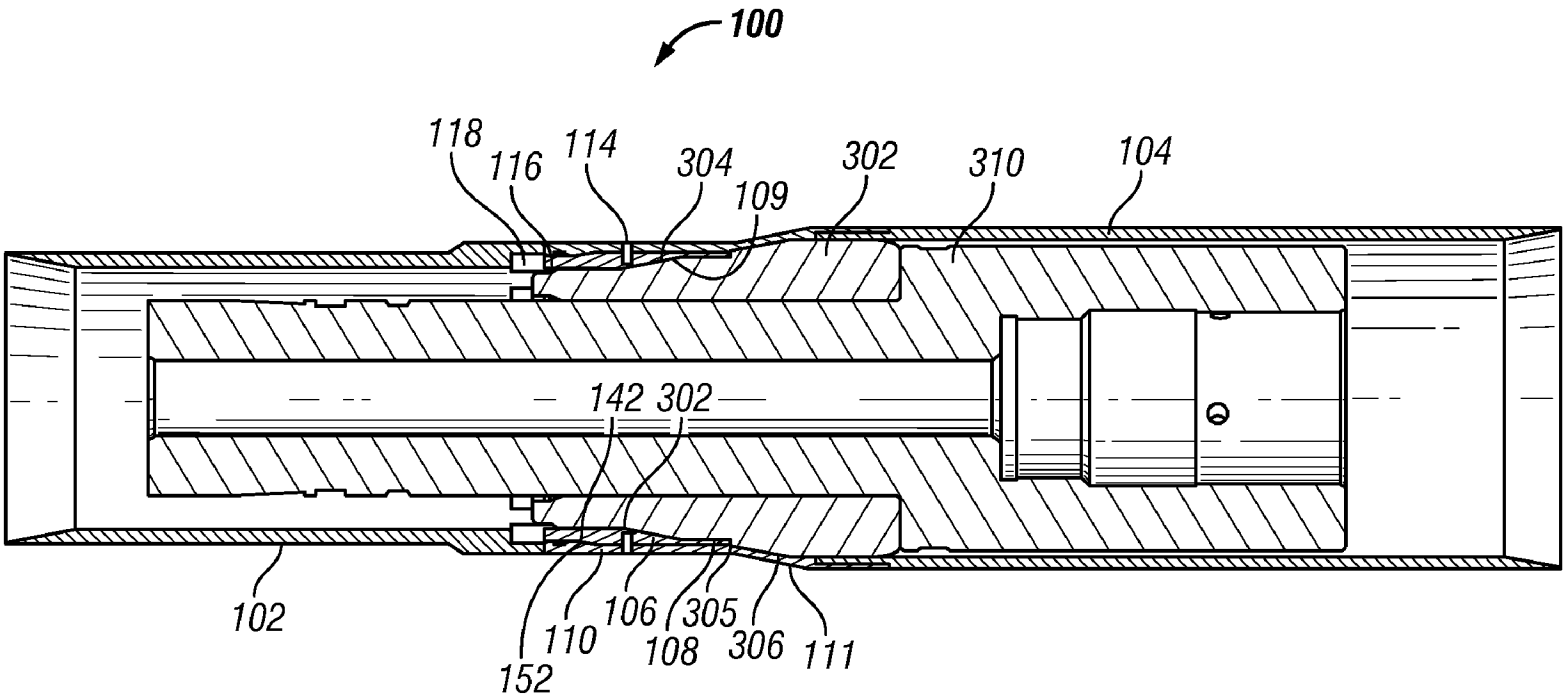
FIG. 14 is a cross-section view of the releasable joint assembly and expansion device of FIG. 13, with the expansion device further radially expanding the slider receptacle and engaging the slider.

The expansion cone 302 continues to be forced through the assembly 100, such that the cone 302 has expanded the lower tubular member 104, begins to radially expand the receptacle 110 at 111, and engages the slider 106, as is shown in FIG. 14. The cone shoulder 305 engages the lower end of the slider seat portion 108, and the first tapered expansion surface 304 engages the tapered seat surface 109. As previously described, the releasably secured slider 106 and receptacle 110 include mating tapered surfaces 152, 142 and 154, 144.

Figure 15:
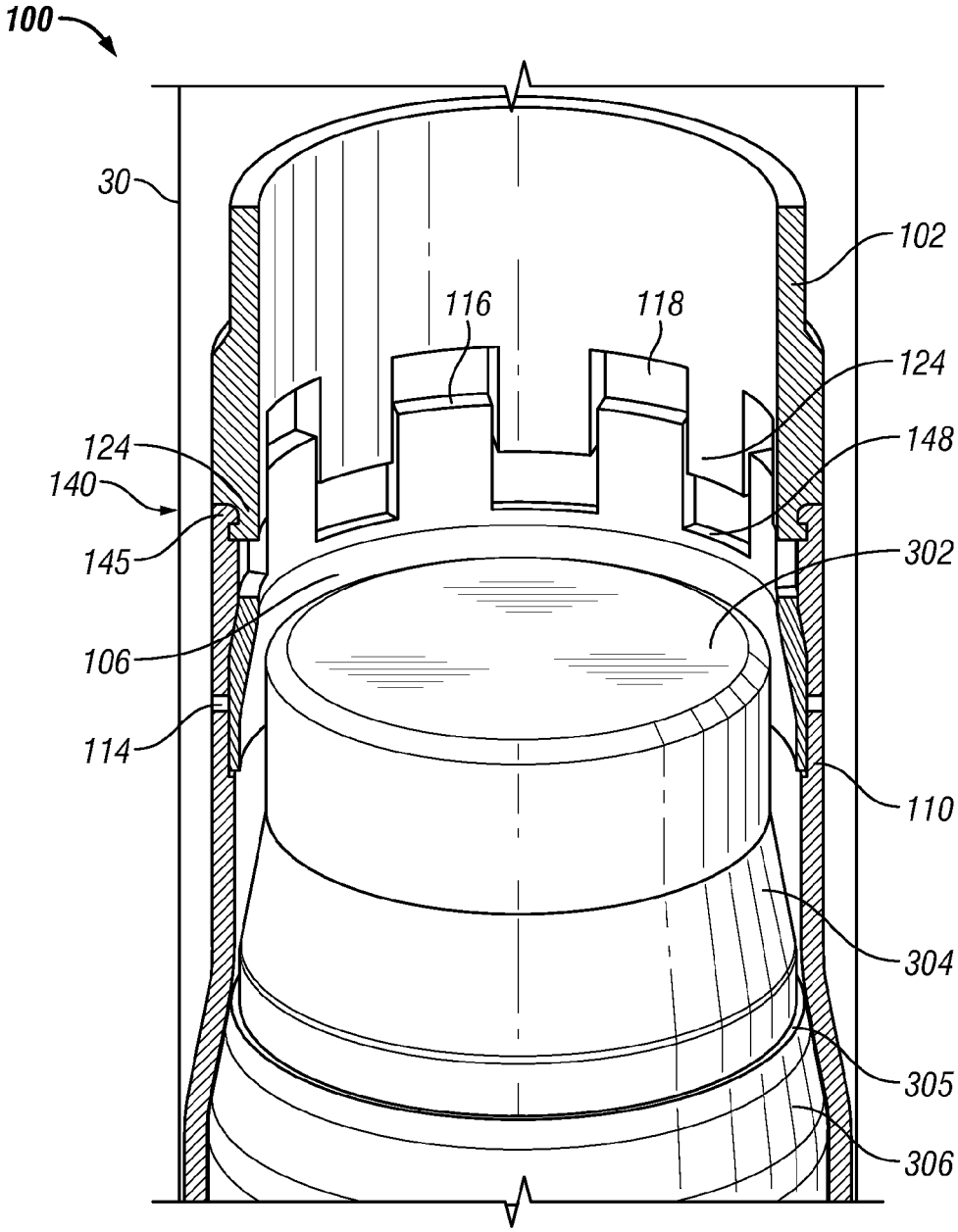
FIG. 15 is a partial cross-section view of the releasable joint assembly and expansion device in between the positions of FIGS. 13 and 14.

Referring to FIG. 15, the partially expanded joint assembly 100 is shown in a position between those positions shown in FIGS. 13 and 14, just before the cone 302 engages the slider 106. As shown, the cone 302 is expanding the receptacle 110 with the tapered expansion surfaces 304, 306. The slider 106 is releasably secured to the receptacle 110 by shear pins 114. The collet connection 140 is maintained by the mating latches 124, 145 between the upper tubular member 102 and the receptacle 110.

Figure 16:
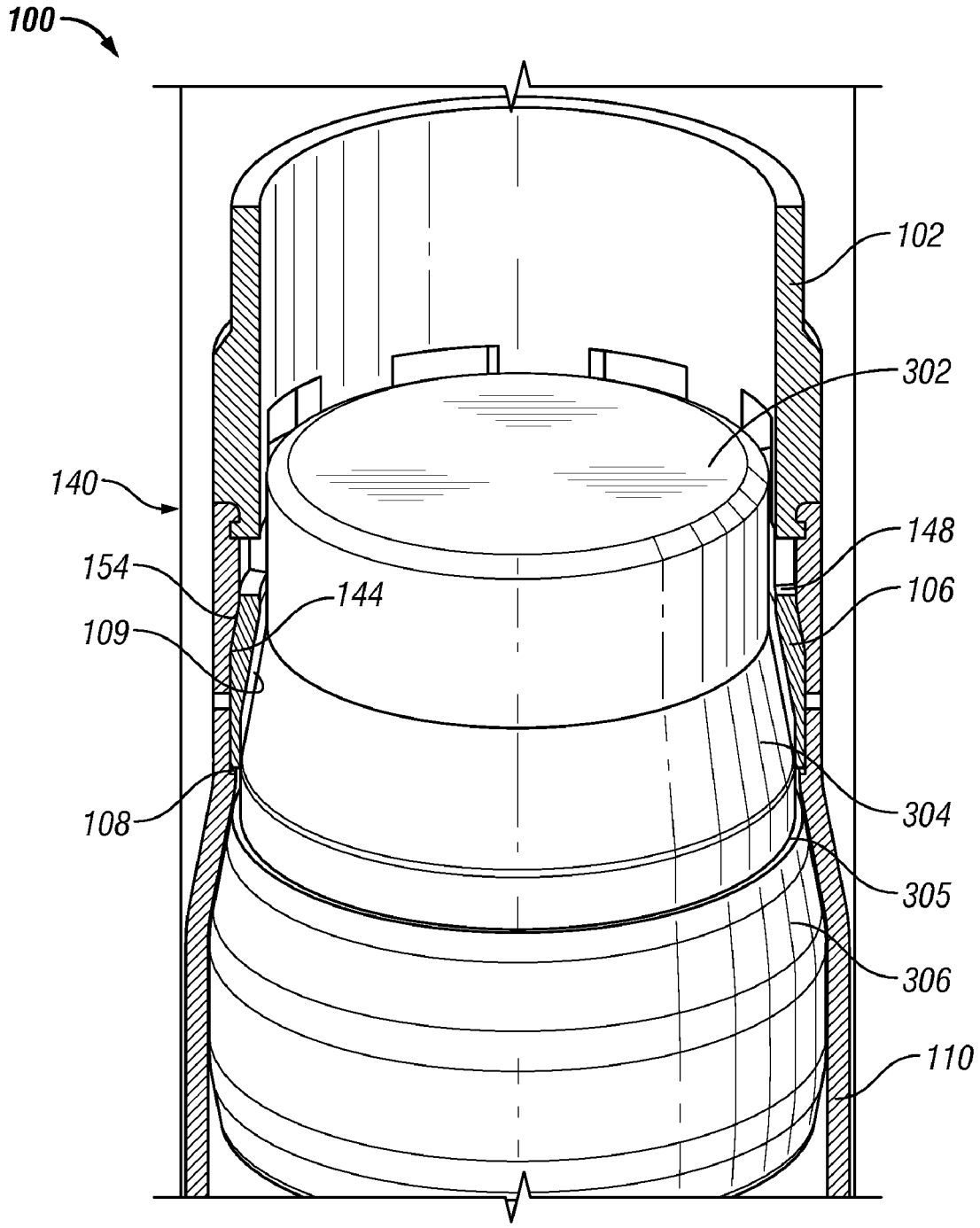
FIG. 16 is a partial cross-section view of the releasable joint assembly and expansion device in a similar position to that shown in FIG. 14.
Figure 17:
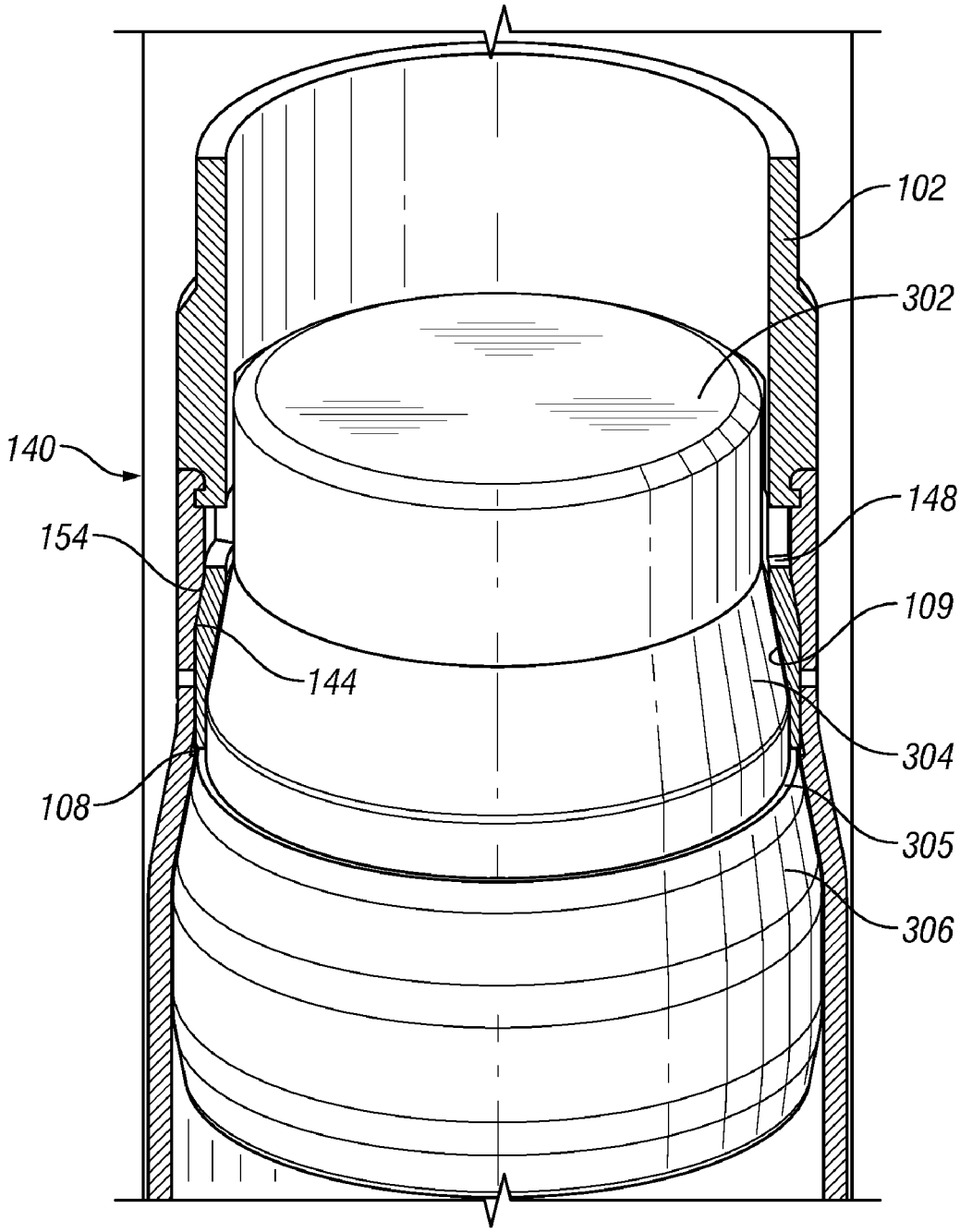
FIG. 17 is a partial cross-section view of the releasable joint assembly and expansion device in the same position as that shown in FIG. 14.

Referring to FIG. 16, the partially expanded joint assembly 100 is shown in a position similar to that shown in FIG. 14. The cone shoulder 305 nearly engages the lower end of the slider seat portion 108, and the first tapered expansion surface 304 nearly engages the tapered seat surface 109. The second tapered expansion surface 306 continues to radially expand and plastically deform the receptacle 110. As previously described, the releasably secured slider 106 and receptacle 110 include mating tapered surfaces 152, 142 and 154, 144. However, unlike in FIG. 14, the section of the joint assembly 100 is taken through the slider slots 148 such that the lower mating surfaces 154, 144 between the slider and receptacle are shown engaged. FIG. 17 shows a partial cross-section view of the position of the assembly 100 and expansion cone 302 as shown in FIG. 14.

Figure 18:
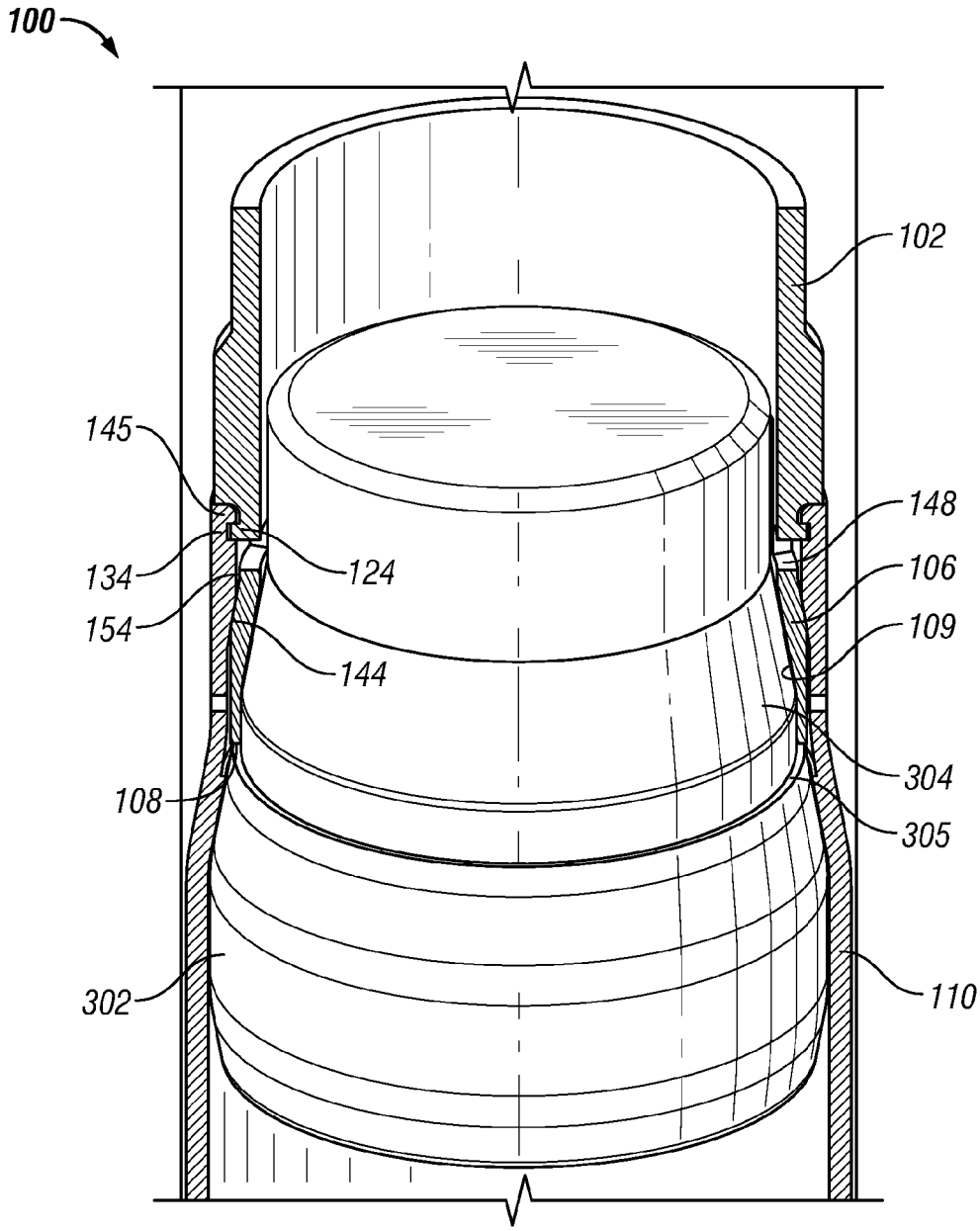
FIG. 18 is a partial cross-section view of the releasable joint assembly and expansion device with an axially moved slider and a partially released collet connection.

Referring to FIG. 18, the expansion cone is shown beginning to radially expand and release the collet connection 140 due to the cone's continued axial displacement through the assembly 100. The seat portion 108 of the slider 106 remains engaged and supported by the cone shoulder 305, and the tapered seat surface 109 remains engaged with the tapered expansion surface 304. As the cone 302 continues to move axially, it forces the slider 106 axially upward, causing the mating tapered surfaces 154, 144 to slide relative to each other. This sliding action causes the robustly supported slider surfaces 154 to press radially outward on the surfaces 144 and the flexible collet fingers 134. As shown in FIG. 18, the axial length of the slots 148 have decreased and the latches 145 have begun to separate from the latches 124.

Figure 19:
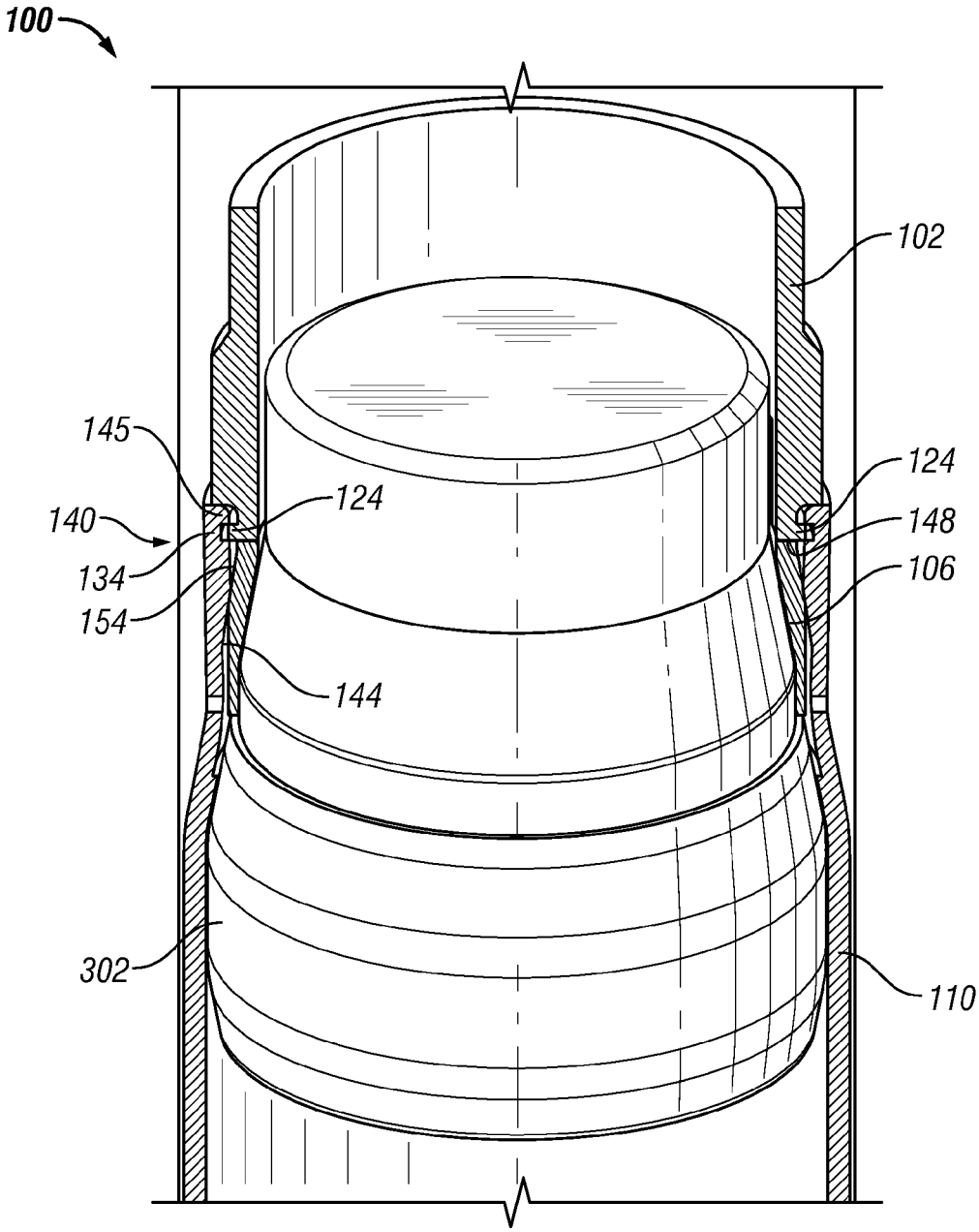
FIG. 19 is a partial cross-section view of the releasable joint assembly and expansion device with an engaged slider and a released collet connection.

Referring now to FIG. 19, additional axial movement by the cone 302 causes continued upward sliding of the slider surfaces 154, forcing the collet fingers 134 further radially outward until there is an axial clearance between the latches 145 and the latches 124. The collet connection 140 is now released. Also, the latches 124 of the upper tubular member 102 engage or bottom out in the slots 148 of the slider 106. With reference to FIG. 15, the splines 116 also fully engage the slots 118. In this manner, the slider 106 has come to a positive stop causing a pressure spike indication at the surface. The pressure spike indication can be used to suspend radial expansion, and then remove the unexpanded upper tubing string from the well bore as explained below. In other embodiments, if the lower pipe is being expanded by pulling forces from the surface with the drilling rig, then there is no hydraulic pressure indication at the surface. In this case, the release joint simply opens as the cone moves through it and the release is indicated by a decrease in hook load at the surface. The upper section is then pulled from the hole.

Figure 20:
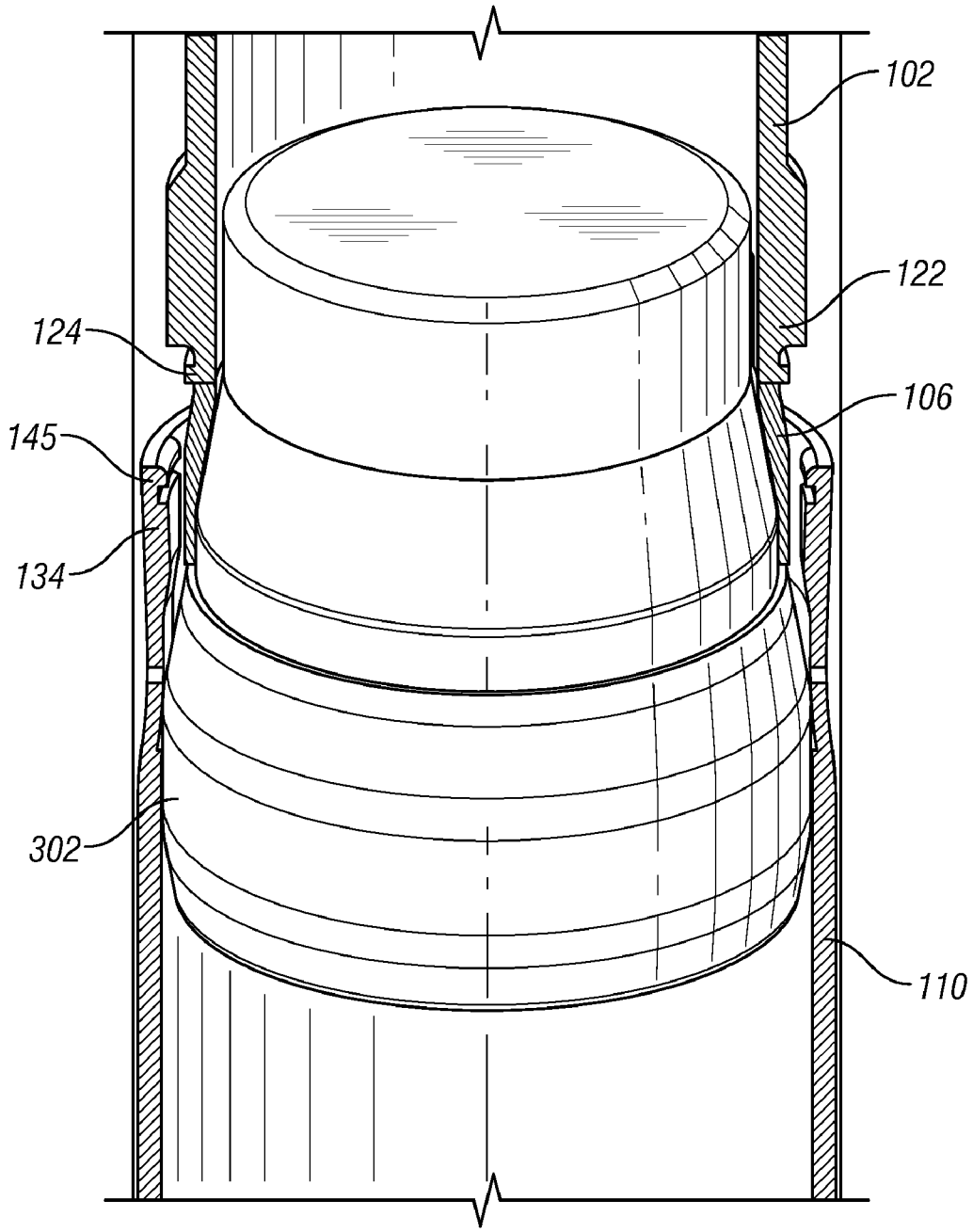
FIGS. 20-22 are partial cross-section views showing the released joint and removal of the expansion device, slider, and upper tubular member.
Figure 21:
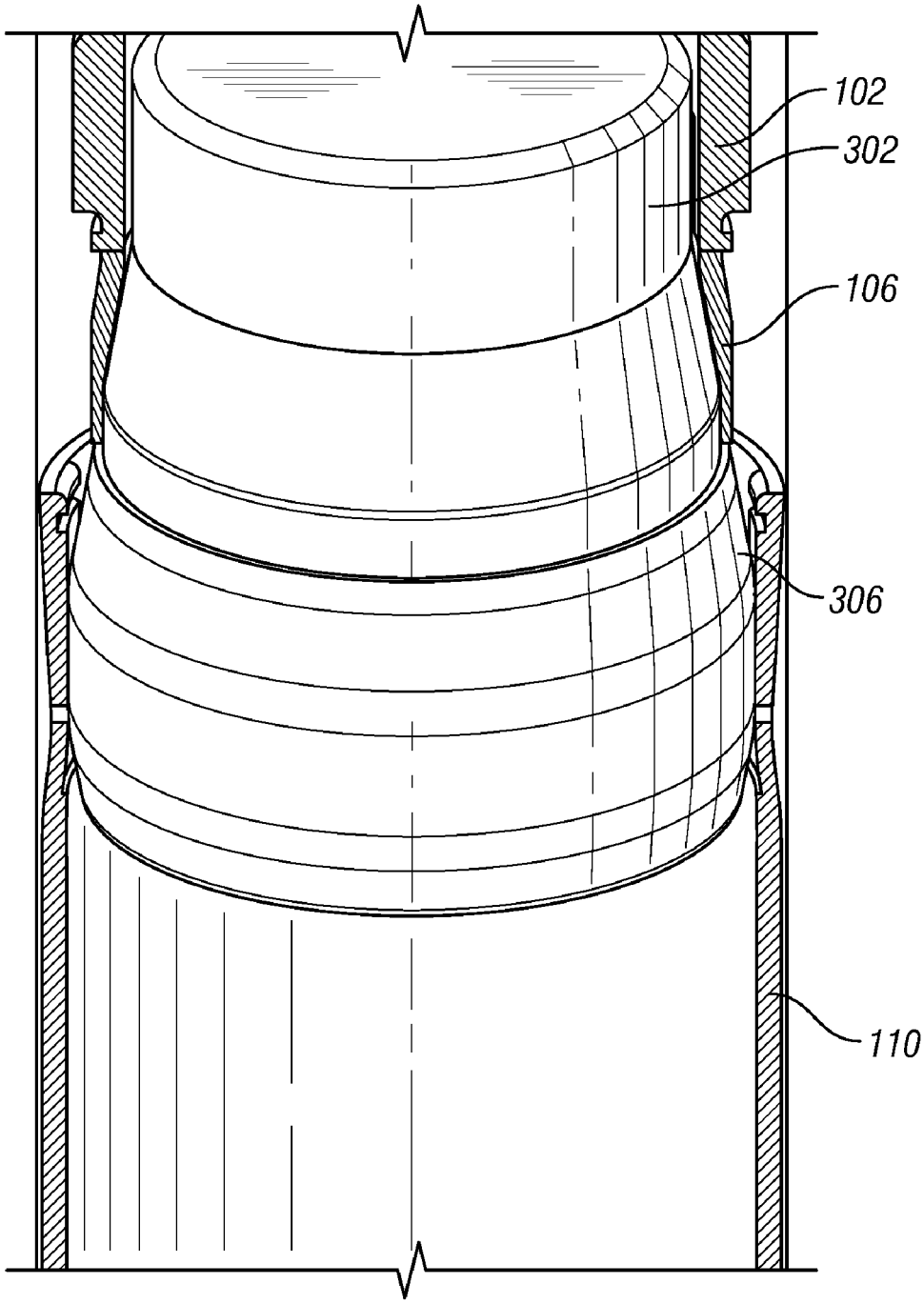
Figure 22:
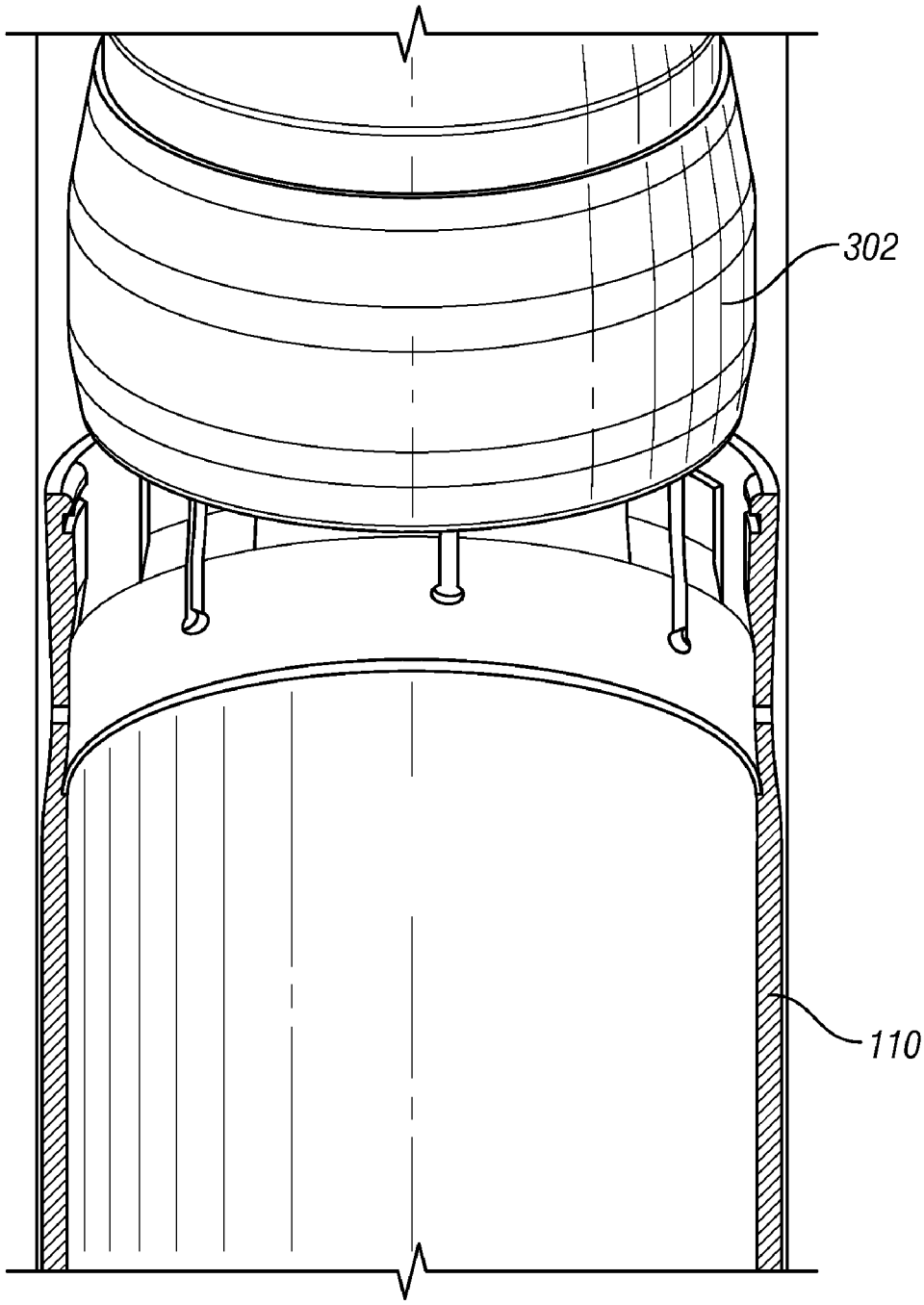

Referring to FIG. 20, the collet connection 140 has been released because the collets 134 have been radially expanded to an extent that clears the latches 145 from the latches 124 for relative axial movement. Continued axial displacement of the cone 302 also moves the slider 106 in the same direction. Because the end 122 of the upper tubular member 102 is bottomed out on the slider 106 (via the latches 124 fully engaged in the slots 148, and the splines 116 fully engaged in the slots 118, as best shown with reference to FIG. 15), the cone 302 now axially displaces the upper tubular member 102 relative to the receptacle 110 and the rest of the tubular string attached below it. As shown in FIGS. 21 and 22, the cone 302 can continue to be moved axially, such as by pulling the support tubular 310 in FIG. 3, to finish expanding the receptacle 110 via the tapered surface 306 and remove the cone 302 from the expanded receptacle 110 and lower tubular string. The cone 302, the slider 106, the upper tubular member 102, and the rest of the upper unexpanded tubular string can then be removed from the well bore to the surface.

Figure 23:
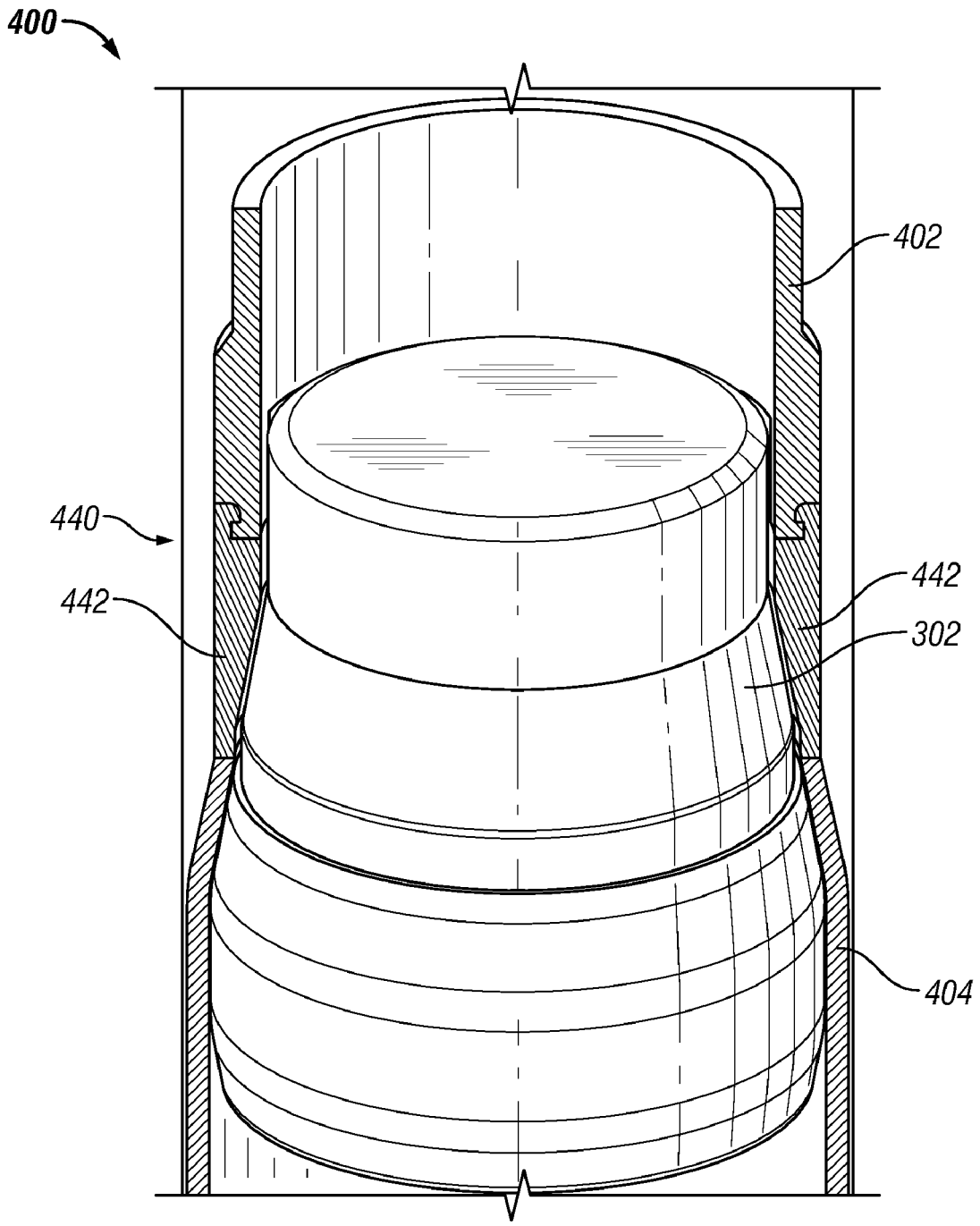
FIG. 23 is a partial cross-section view of an alternative embodiment of the releasable joint assembly, including a flexible ring connection.
Figure 24:
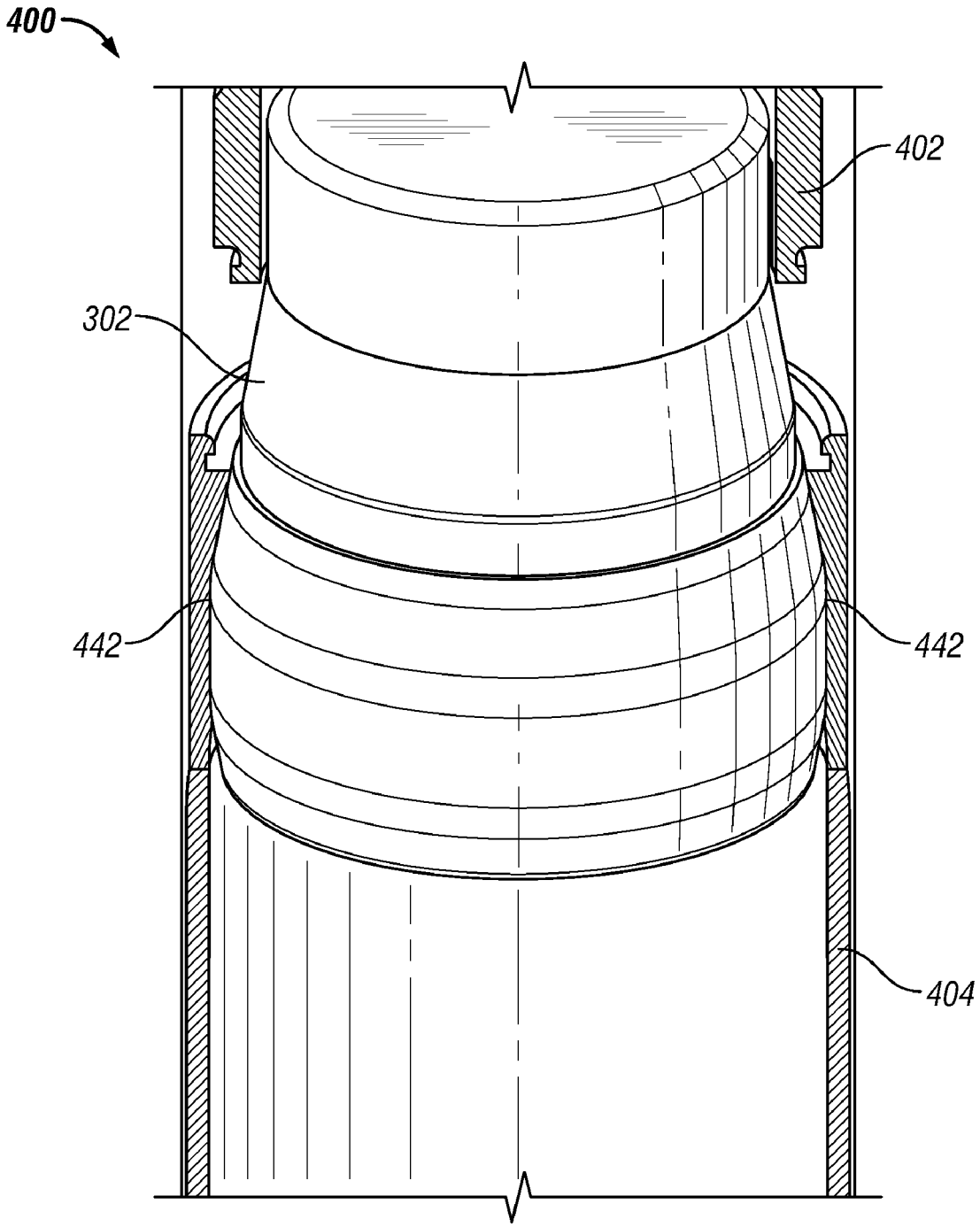
FIG. 24 is the assembly of FIG. 24 wherein the flexible ring is released from the upper tubular member in response to the radial expansion force of an expansion device.
Figure 25:
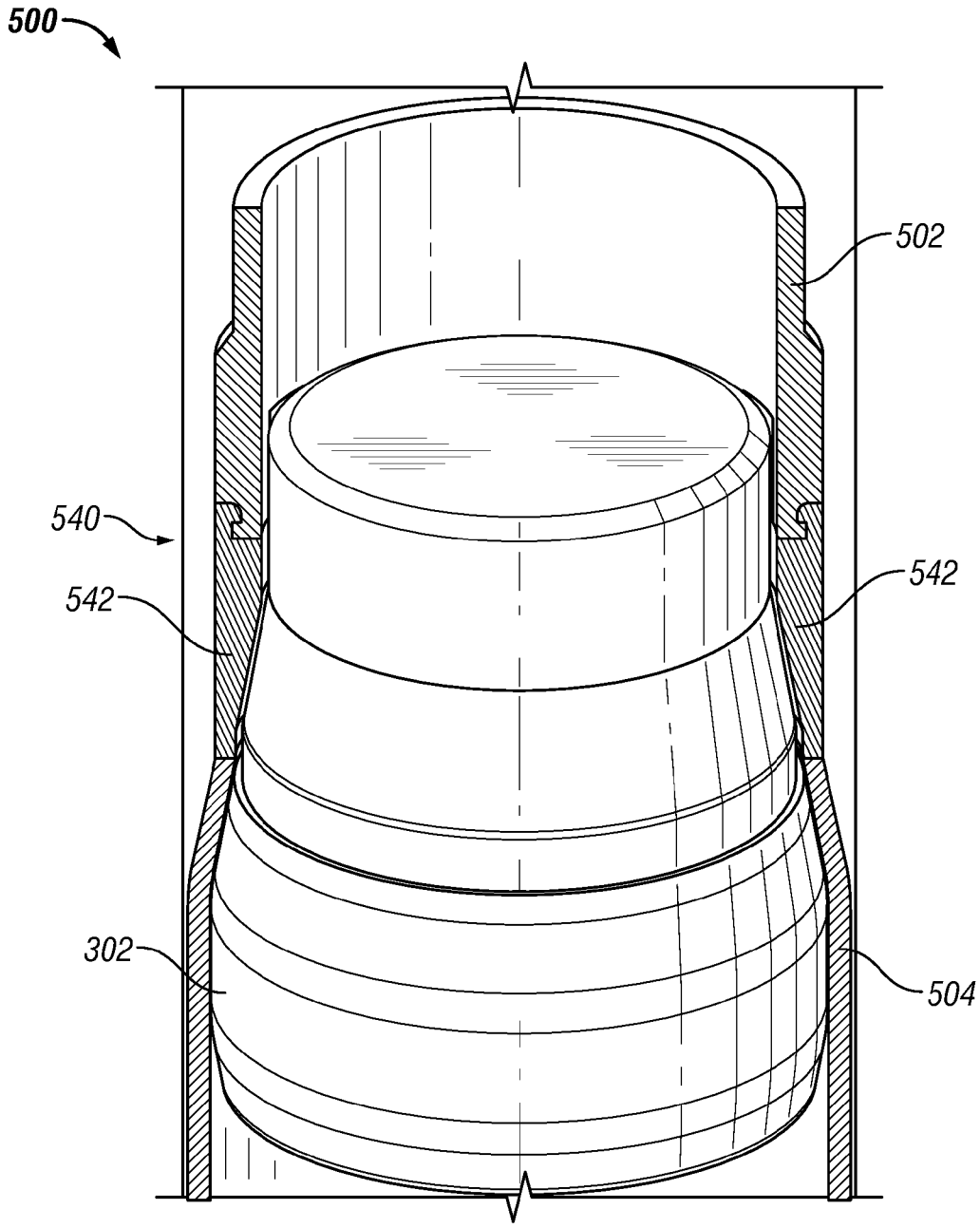
FIG. 25 is a partial cross-section view of a further alternative embodiment of the releasable joint assembly, including a frangible ring connection.
Figure 26:
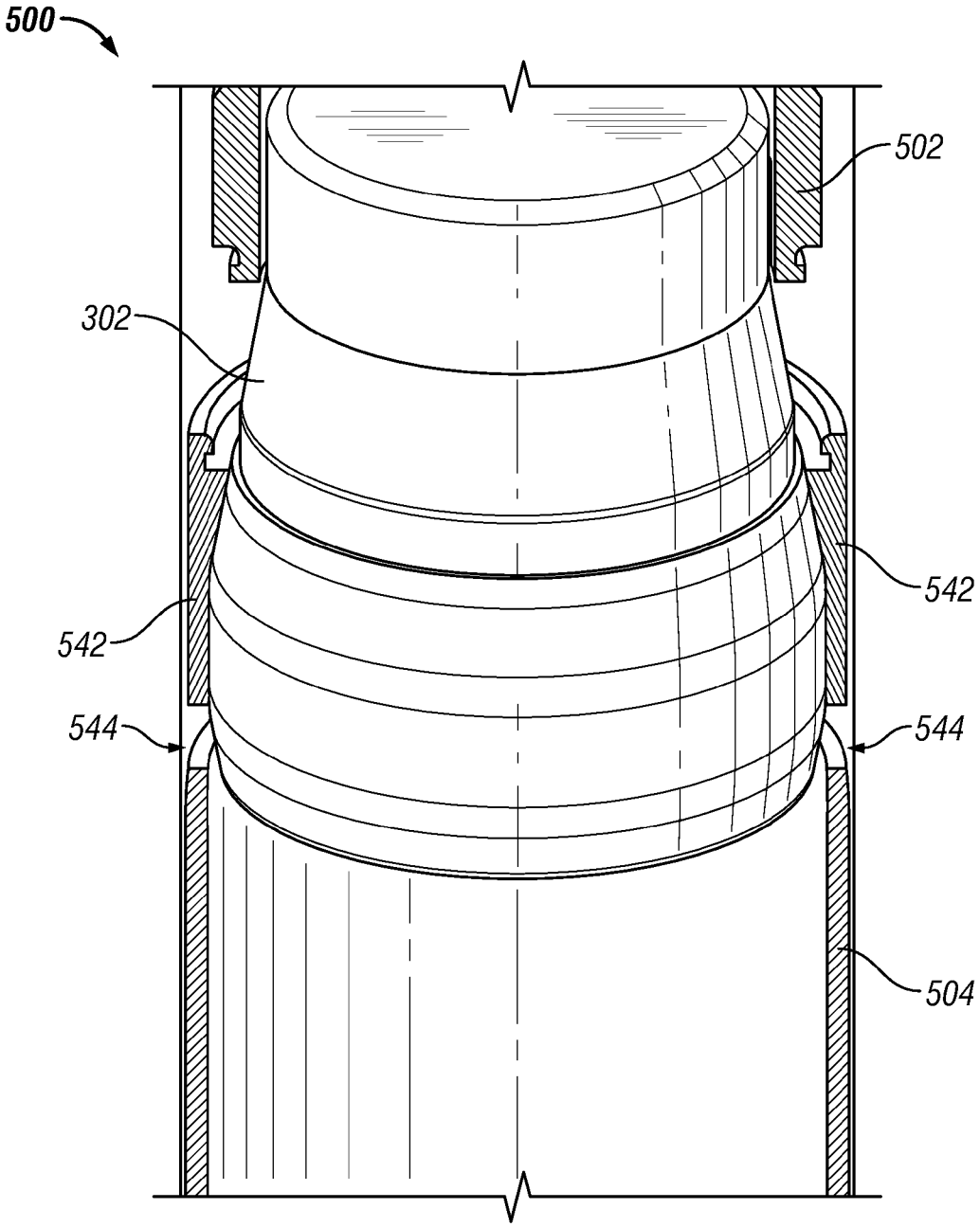
FIG. 26 is the assembly of FIG. 25 wherein the frangible ring is released from the upper tubular member by being destroyed in response to the radial expansion force of an expansion device.

In various embodiments described herein, the mechanical joint assembly 100 is adapted to separate into two parts when radially expanded by an expansion device. Other radially expandable and releasable connections are contemplated other than the collet connection. For example, the collet fingers can be replaced by a robust but flexible elastomeric material or ring 442 that retains the upper tubular member 402 in an assembly 400 as shown in FIG. 23. The elastomeric ring 442 expands in reaction to the expansion force of the expansion device 302 to release the tubular member 402, as shown in FIG. 24. In other embodiments, the release mechanism in the joint is a frangible material 542 that retains the upper tubular member 502 in an assembly 500 as shown in FIG. 25. The frangible ring 542 breaks from the lower tubular member 504 at 544 in reaction to the expansion force of the expansion device 302 to release the tubular member 502, as shown in FIG. 26. In other words, various embodiments of the releasable connection between the two tubular members include a collet collection, or alternative retention and release mechanisms that react to a radial expansion force to release the upper tubular member from the lower expanded tubular member.

In various embodiments described herein, a downhole releasable tubing connection includes a joint between two tubing strings, wherein one of the two tubing strings is radially expanded and plastically deformed by an expansion device. When the expansion device is moved adjacent to the joint, a mechanism in the joint reacts to the radially outward forces of the expansion device and releasably expands, separates, breaks, or otherwise provides a release between the two tubing strings. One tubing string and the expansion device can then be removed to the surface of the well bore while the expanded tubing remains installed in the well bore.

In some embodiments, a first tubular member disposed in a well bore, a second tubular member disposed in the well bore, an expansion device is coupled to the second tubular member, and a connection is coupled between the first and second tubular members including a retention mechanism that is releasable in response to radial expansion and plastic deformation of the second tubular member by the expansion device. The apparatus may include a radially releasable collet connection. A collet finger of the collet connection may radially expand in response to the radial expansion force of the expansion device. The apparatus may include a sliding member disposed between the expansion device and the collet finger. The retention and release mechanism may include a series of collet fingers on the second tubular member interlocked with latches on the first tubular member. The apparatus may include a slider coupled between the collet fingers and the latches. The slider may prevent relative rotation between the tubular members. The slider may include splines received in aligned slots of the tubular members. The splines may move in the aligned slots in response to axial displacement of the expansion device during radial expansion and plastic deformation. In some embodiments, the retention and release mechanism is an elastomeric member. In some embodiments, the retention and release mechanism is a frangible member. The first tubular member may be a tubing string removable to the surface of the well bore and the second tubular member may be an expandable casing installable in the well bore.

In some embodiments, a downhole apparatus includes a first downhole tubular member, a radially expandable second downhole tubular member, and a releasable connection coupled between the first and second tubular members configured to receive an expansion device from the radially expandable second tubular member. The releasable connection may include a collet connection between the first and second tubular members. The collet connection may be releasable in response to a radial expansion force of the expansion device. The apparatus may include a sliding member coupled to the collet connection. The sliding member may be moveable in response to axial displacement of the expansion device. The sliding member may activate the collect connection. The sliding member may include splines interlocking with slots in the collet connection.

In some embodiments, a method of releasing two downhole tubular members includes coupling the two tubular members with a releasable connection, displacing an expansion device through one of the tubular members to radially expand and plastically deform the tubular member, and releasing the connection between the two tubular members by displacing the expansion device therethrough. The method may include coupling the two tubular members with a releasable connection by engaging a collet connection and releasing the collet connection by radially expanding collet fingers in response to the displacement of the expansion device. The method may include radially expanding an elastomeric ring. The method may include breaking a frangible ring. The method may include installing against a well bore the radially expanded and plastically deformed tubular member and removing to the surface of the well bore with the expansion device the released other tubular member.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A downhole apparatus comprising:

a first tubular member disposed in a well bore;

a plurality of circumferentially spaced-apart slots interleaved with a plurality of latches disposed on an end of the first tubular member;

a second tubular member disposed in the well bore;

a circumferential groove disposed on an end of the second tubular member, wherein the circumferential groove engages the plurality of latches disposed on an end of the first tubular member;

an expansion device coupled to the second tubular member;

a sliding member disposed within and releasably coupled to the second tubular member; and a plurality of splines extending from the sliding member and engaged with the plurality of slots disposed on an end of the first tubular member.

2. The downhole apparatus of claim 1, wherein the expansion device has a tapered outer surface that engages a tapered inner surface of the sliding member as the expansion device moves axially through the second tubular member.

3. The downhole apparatus of claim 1, wherein the expansion device has a shoulder that engages an end of the sliding member as the expansion device moves axially through the second tubular member.

4. The downhole apparatus of claim 1, wherein the sliding member has a tapered outer surface that engages a tapered inner surface of the second tubular member.

5. The downhole apparatus of claim 1, wherein the circumferential groove includes a plurality of slots circumferentially spaced to allow the plurality of latches disposed on an end of the first tubular member to be axially inserted into the circumferential groove.

6. The downhole apparatus of claim 1, wherein the second tubular member includes a plurality of collet slots.

7. A method of expanding a tubular in a wellbore:

axially coupling a first tubular to a second tubular by engaging a plurality of circumferentially spaced latches disposed on an end of the first tubular with a circumferential groove disposed on an end of the second tubular;

rotationally coupling the first tubular to the second tubular by disposing a sliding member in the second tubular such that a plurality of splines extending from the sliding member engage a plurality of slots disposed on the end of the first tubular and releasably engaging the sliding member with the second tubular;

disposing the first and second tubulars into a wellbore;

axially displacing an expansion device through the second tubular so as to radially expand the second tubular;

engaging the sliding member with the expansion device so as to release the sliding member from the second tubular; and axially displacing the sliding member and the expansion device so as to radially expand the circumferential groove on the end of the second tubular member and release the latches from the circumferential groove.

8. The method of claim 7, wherein the expansion device has a tapered outer surface that engages a tapered inner surface of the sliding member as the sliding member engages the expansion device.

9. The method of claim 7, wherein the expansion device has a shoulder that engages an end of the sliding member as the sliding member engages the expansion device.

10. The method of claim 7, wherein the sliding member has a tapered outer surface that engages a tapered inner surface of the second tubular member.

11. The method of claim 7, wherein the circumferential groove includes a plurality of slots circumferentially spaced to allow the plurality of latches disposed on an end of the first tubular member to be axially inserted into the circumferential groove.

12. The method of claim 7, wherein the second tubular member includes a plurality of collet slots.

13. The method of claim 7, further comprising removing the sliding member, the first tubular, and the expansion device from the wellbore.

* * * * *